US006737585B2

(12) United States Patent
Aoyama et al.

(10) Patent No.: US 6,737,585 B2
(45) Date of Patent: May 18, 2004

(54) WIRE HARNESS

(75) Inventors: Masahiko Aoyama, Yokkaichi (JP); Yasushi Saitoh, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/955,193

(22) Filed: Sep. 19, 2001

(65) Prior Publication Data

US 2002/0038717 A1 Apr. 4, 2002

(30) Foreign Application Priority Data

Sep. 22, 2000 (JP) ..... 2000-289266

(51) Int. Cl.[7] ..... H01B 17/16

(52) U.S. Cl. ..... 174/68.1; 174/68.3; 174/72 A; 174/135; 439/207; 52/220.7

(58) Field of Search ..... 174/68.1, 68.3, 174/72 A, 135, 95, 97, 72 R; 439/207; 52/220.7

(56) References Cited

U.S. PATENT DOCUMENTS 4,815,984 A * 3/1989 Sugiyama et al. ..... 439/211
6,435,921 B2 8/2002 Kojima et al.
6,439,923 B1 * 8/2002 Kirkendall et al. ..... 439/502
6,444,903 B2 * 9/2002 Saeki et al. ..... 174/48

FOREIGN PATENT DOCUMENTS

| | | | |
|---|---|---|---|
| EP | 0 644 619 A2 | | 3/1995 |
| EP | 0 651 474 A2 | | 5/1995 |
| JP | 11-25781 A | | 1/1999 |
| JP | 11025781 | | 1/1999 |
| JP | 11-025781 | * | 1/1999 |

* cited by examiner

*Primary Examiner*—Dhiru R Patel
(74) *Attorney, Agent, or Firm*—Oliff & Berridge, PLC

(57) ABSTRACT

A wire harness 10 includes sharable housings Ha to Hg which enable insertion of terminals either insulation displacement terminals Ta and crimp terminals Tb; a first sub-harness formed by inserting the insulation displacement terminals Ta into the sharable housings Ha to Hg; a second sub-harness 10*b* formed in the same manner as the first sub-harness 10*a*; and an after-insertion electric wire WR having the crimp terminals Tb crimped at both ends. The crimp terminals Tb of the after-insertion electric wire WR is inserted into a sharable housing H, thereby connecting the sub-harnesses 10*a* and 10*b*. The crimp terminals Tb are used for only terminal hardware to be connected to the after-insertion electric wire WR which requires adhesion strength between an electric wire and terminal hardware. The majority of remaining terminal hardware pieces are embodied as the insulation displacement terminals Ta.

7 Claims, 16 Drawing Sheets

WIRE HARNESS

BACKGROUND OF THE INVENTION

1. Field of the Invention

The present invention relates to a wiring harness formed by combination of a plurality of sub-harnesses.

2. Description of the Related Art

A wiring harness for use in an automobile usually comprises a plurality of electric wires and connectors and has a complicatedly-branched geometry. Assembly of a wiring harness into a finished product through a single operation is not easy. Therefore, there is employed a series of manufacturing processes wherein a wiring harness is separated into a plurality of sub-harnesses of smaller blocks. After having been assembled individually, the sub-harnesses are connected into a completed wiring harness (see, for example, Japanese Patent Application Laid-Open No. 25781/1999).

The size of each block of sub-harness is determined in consideration of ease of assembly of sub-harnesses. For example, a wiring harness is separated into sub-harnesses such as those shown in FIG. 14. Sub-harnesses 101X and 101Y are assembled, by means of inserting terminal hardware pieces 104F connected to respective ends of electric wires 103 extending between a plurality of connectors 102A, 102B, 102C, 102D, and 102E. As a result of the wiring harness having been separated in the manner as mentioned above, the electric wires 103 must be connected to other sub-harnesses (not shown) disposed between the two sub-harnesses 101X and 101Y. Therefore, after-insert terminals 104R each having one end that is not connected to the connectors 102A through 102C are exposed outside the sub-harnesses 101X and 101Y so as to be inserted into other sub-harnesses in a subsequent bundling process.

As shown in FIG. 15, the sub-harness 101X is laid along wire holders 106 situated upright on a work table 105 for assembling and bundling the sub-harnesses 101X and 101Y. In this state, the after-insert terminals 104R to be inserted into the connectors 102D and 102E of the remaining sub-harness 101Y remain exposed. Subsequently, as shown in FIG. 16, the remaining sub-harness 101Y is laid along predetermined paths, and the after-insert terminals 104R of the sub-harness 101X are inserted into the corresponding connectors 102D and 102E, respectively. Similarly, the after-insert terminals 104R of the sub-harness 101' are also inserted into the corresponding connectors 102A and 102B of the sub-harness 101X. Thus, the wiring harness is assembled.

Terminal hardware which is connected to the terminals of the electric wires 103 and is to be inserted into the connectors 102A through 102E includes a insulation displacement terminal 104*a* and a crimp terminal 104*b*. As shown in FIG. 17, the insulation displacement terminal 104*a* is constituted by means of press-fitting the electric wire 103 into pressure-connecting blades 107. As shown in FIG. 18, an insulating sheath 103*a* provided at the extremity of the electric wire 103 is stripped, thereby uncovering cores 103*b*. The thus-exposed cores 103*b* are crimped by means of a wire barrel 108, thereby constituting the crimp terminal 104*b*.

In connection with the crimp terminal 104*b*, the cores 103*b* are strongly crimped by the wire barrel 108 by means of a press. Hence, there is yielded an advantage of superior reliability of electrical contact with the electric wire 103. Further, the crimp terminal 104*b* possesses high tensile strength and is less impervious to causing removal of the electric wire 103. However, processing pertaining to complicated processes, such as stripping of the electric wire 103 and crimping of the electric wire using a press machine, must be performed for each of the crimp terminals 104*b* (for each electric wire 103). Thus, the wiring harness becomes costly, thereby deteriorating manufacturing efficiency.

In connection with the insulation displacement terminal 104*a*, there is no necessity of stripping the electric wire 10 or press-fitting the electric wire 103 to the insulation displacement terminal 104*a*. The only requirement is to merely push the electric wire 103 into the pressure-connecting blades 107. By means of a single operation, a plurality of electric wires 103 can be pressure-connected to a plurality of insulation displacement terminals 104*a* aligned in line. Further, a process of inserting the insulation displacement terminal 104*a* crimped to the electric wire 103 into the connectors 102A through 102E can be automated. Hence, there is yielded an advantage of ability to efficiently manufacture sub-harnesses at lower cost.

In order to curtail manufacturing costs or improve manufacturing efficiency, all terminal hardware pieces, including the terminals 104F to be inserted into the connectors 102A through 102E and after-insertion terminals 104R which remain exposed and are not inserted into the connectors 102A through 102E when the sub-harnesses 101X and 101Y are not combined, are desirably formed from the insulation displacement terminals 104*a*.

However, in relation to the insulation displacement terminal 104*a*, the electric wire 103 is merely press-fitted into the pressure-connecting blades 107. Hence, the electric wire 103 is readily removed from the insulation displacement terminal 104*a*. Further, press-fitting is inferior to crimping in terms of protection of a connection section (i.e., a pressure-connecting section) under external force. The after-insertion terminals 104R are transported or handled while temporarily being in an exposed state. Against such a backdrop, crimp terminals 104*b*, rather than insulation displacement terminals 104*a*, are more preferably employed as the after-insertion terminals 104R.

In relation to the electric wire 103 of the after-insertion terminal 104R, there is a conceivable method of connecting the insulation displacement terminals 104*a* to ends of the electric wires 103 to be inserted into the connectors 102A through 102E and connecting the crimp terminals 104*b* to the remaining ends of the electric wires 103 as the after-insertion terminals 104R. However, connecting two different connection types of terminal hardware pieces; that is, the insulation displacement terminal 104*a* involving press-fitting and the crimp terminal 104*b* involving crimping, to a single electric wire 103 results in considerable deterioration of manufacturing efficiency. Hence, such a method is desirably avoided.

Crimping is not applied solely to connection of the after-insertion terminal 104R. For instance, terminal hardware (see FIG. 19) to be connected to an electric wire of special form, such as a shield wire 103S having a shield layer 103Sa, and terminal hardware (see FIG. 20) which is to be used in an exposed form and not connected to a connector even when a wiring harness is completed (see FIG. 20), such as a ground terminal 104E, must employ crimping as a connecting method.

As mentioned above, in terms of cost, use of the insulation displacement terminals 104*a* is preferable at the time of manufacture of the sub-harnesses 101X and 101Y and a wiring harness. In spite of this, there has been a necessity of employing crimp terminals 104*b* for a portion of terminal hardware pieces. Further, difficulty is encountered in mixedly employing the crimp terminal 104*b* and the insulation displacement terminal 104*a* for each of the sub-harnesses 101X and 101Y. Hence, the majority of related-art sub-harnesses 101X and 101Y use only the crimp terminals 104*b*. The insulation displacement terminals 104*a* are used in only special portions of a sub-harness where there is no necessity of using the crimp terminals 104*b*.

SUMMARY OF THE INVENTION

The present invention has been conceived against the foregoing backdrop and an object of the invention is to provide a wiring harness which enables effective heavy use of sub-harnesses using insulation displacement terminals.

To this end, the present invention provides a wire harness formed by combination of a plurality of sub-harnesses, comprising:

a sharable housing which enables insertion of crimp terminals formed by stripping extremities of electric wires and crimping resultantly exposed core wires to a wire barrel and insertion of a insulation displacement terminal formed by pressure-connecting each of electric wires between pressure-connecting blades;

a first insulation displacement sub-harness which has a plurality of housings including the shareable housing and is assembled by means of inserting the insulation displacement terminals pressure-connected to the electric wires into the housings;

a second crimp sub-harness assembled in the same manner as the first sub-harness; and an after-insertion electric wire having the crimp terminals provided at respective ends, wherein the crimp terminal provided one end of the after-insertion electric wire is inserted into the sharable housing of the first sub-harness; the crimp terminal provided at the other end of the after-insertion electric wire is inserted into the sharable housing of the second sub-harness; and the first and second sub-harnesses are coupled together by way of the after-insertion electric wire.

The present invention also provides a wire harness formed by combination of a plurality of sub-harnesses, comprising:

a sharable housing which enables insertion of crimp terminals formed by stripping extremities of electric wires and crimping resultantly exposed core wires to a wire barrel and insertion of a insulation displacement terminal formed by pressure-connecting each of electric wires between pressure-connecting blades;

a first insulation displacement sub-harness which has a plurality of housings including the shareable housing and is assembled by means of inserting the insulation displacement terminals pressure-connected to the electric wires into the housings;

a second crimp sub-harness assembled by means of inserting the crimp terminal crimped to the electric wire into the housing; and an after-insertion electric wire having the crimp terminals provided at respective ends, the crimp terminal provided at one end being inserted into the housing of the second sub-harness, and the crimp terminal provided at the other end remaining uninserted, wherein the crimp terminal provided at the other end of the after-insertion electric wire is inserted into the sharable housing of the first sub-harness, thereby connecting together the fist sub-harness and the second sub-harness by way of the after-insertion electric wire.

Preferably, the second sub-harness has a shield line having crimp terminals provided at both ends, the crimp terminals being inserted into the housing, and/or an earth line having at one end a crimp terminal inserted into the housing and at the other end an uninserted earth terminal. Preferably, the sharable housing has a retainer mount hole communicating to an exterior surface of the sharable housing from an inner wall of the cavity into which the crimp terminal or the insulation displacement terminal is inserted, and a retainer for preventing removal of the crimp terminal and/or the insulation displacement terminal attached to the retainer mount hole.

Preferably, a connection section is formed in each of the crimp terminal and the insulation displacement terminal so as to become identical in shape with a mating terminal; a step is formed in the crimp terminal so as to become identical in shape with the insulation displacement terminal; and a terminal engagement section is formed in the retainer for preventing removal of the crimp terminal and/or the insulation displacement terminal by means of engaging with the step.

There is employed, as a housing for interconnecting the first and second sub-harnesses, a sharable housing compatible with a crimp terminal and a insulation displacement terminal. Only terminal hardware to be connected to an after-insertion electric require which requires adhesion strength between an electric wire and terminal hardware is embodied as a crimp terminal. The majority of terminal hardware pieces which do not require adhesion strength are embodied as insulation displacement terminals. Thus, the present invention is advantageous in terms of cost and manufacturing efficiency.

The first insulation displacement sub-harness is provided with a sharable housing compatible with a crimp terminal and a insulation displacement terminal. A crimp terminal of the after-insertion electric wire of the second crimp sub-harness is inserted into the sharable housing. Thus, the insulation displacement sub-harness and the crimp sub-harness can be coupled together. Of the two sub-harnesses coupled together, a insulation displacement terminal is used for the first sub-harness. When compared with a case where all terminal hardware pieces are embodied as crimp terminals, the present invention is advantageous in terms of cost and manufacturing efficiency.

When either a crimp terminal or a insulation displacement terminal is embodied as terminal to be inserted into a cavity, the terminal hardware can be locked without fail.

The crimp terminal or the insulation displacement terminal inserted into the cavity is locked by means of engaging the step of the crimp terminal or insulation displacement terminal with the terminal engagement section.

DETAIELD DESCRIPTION OF THE PRESENT INVENTION

First Embodiment

Figure 1A:
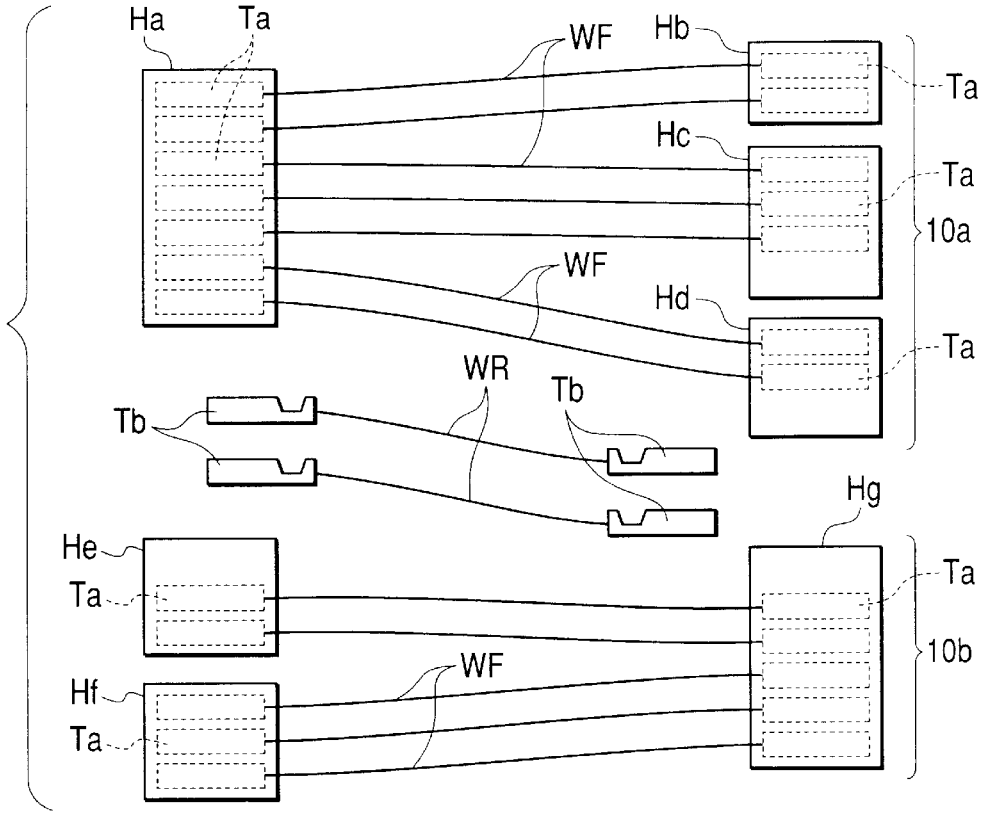
FIGS. 1A and 1B are block diagrams showing a process of coupling sub-harnesses according to a first embodiment of the present invention.
Figure 1B:
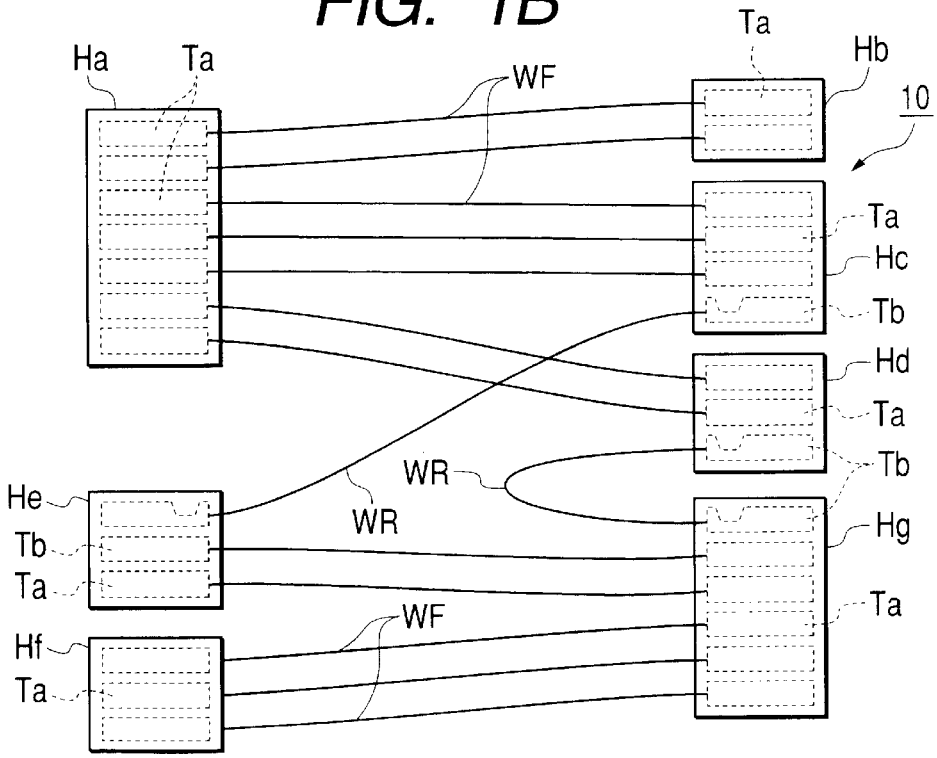
Figure 2:
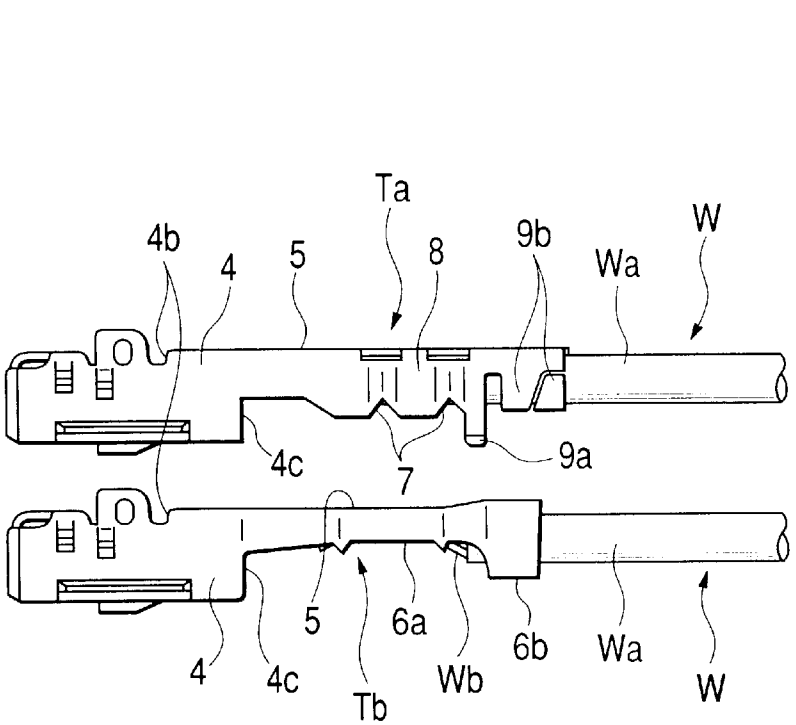
FIG. 2 is a cross-sectional view showing crimp terminals and insulation displacement terminals when they are inserted into a sharable housing.
Figure 3:
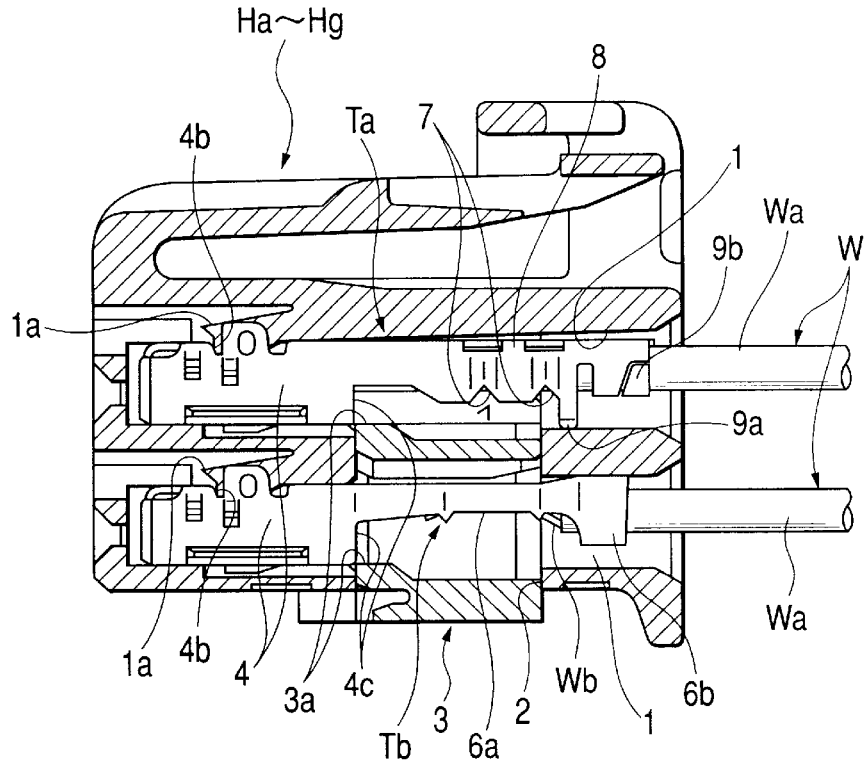
FIG. 3 is a cross-sectional view showing the crimp terminals and the insulation displacement terminals when they are inserted into and subjected to primary engagement.
Figure 4:
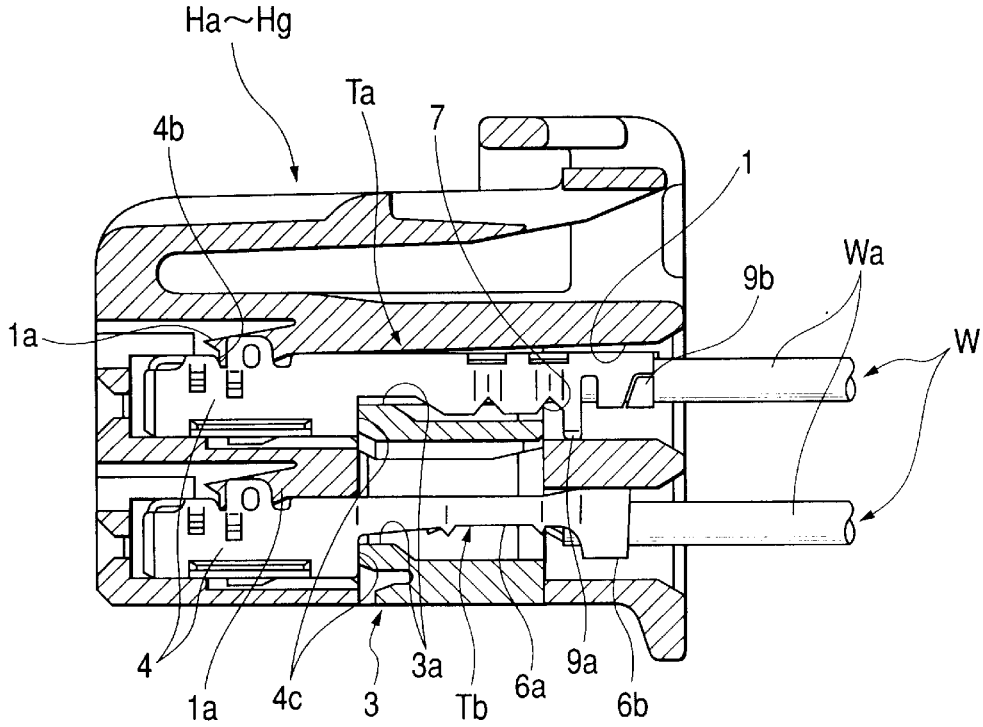
FIG. 4 is a cross-sectional view showing the inserted crimp terminals and the insulation displacement terminals when they are double engaged.
Figure 5:
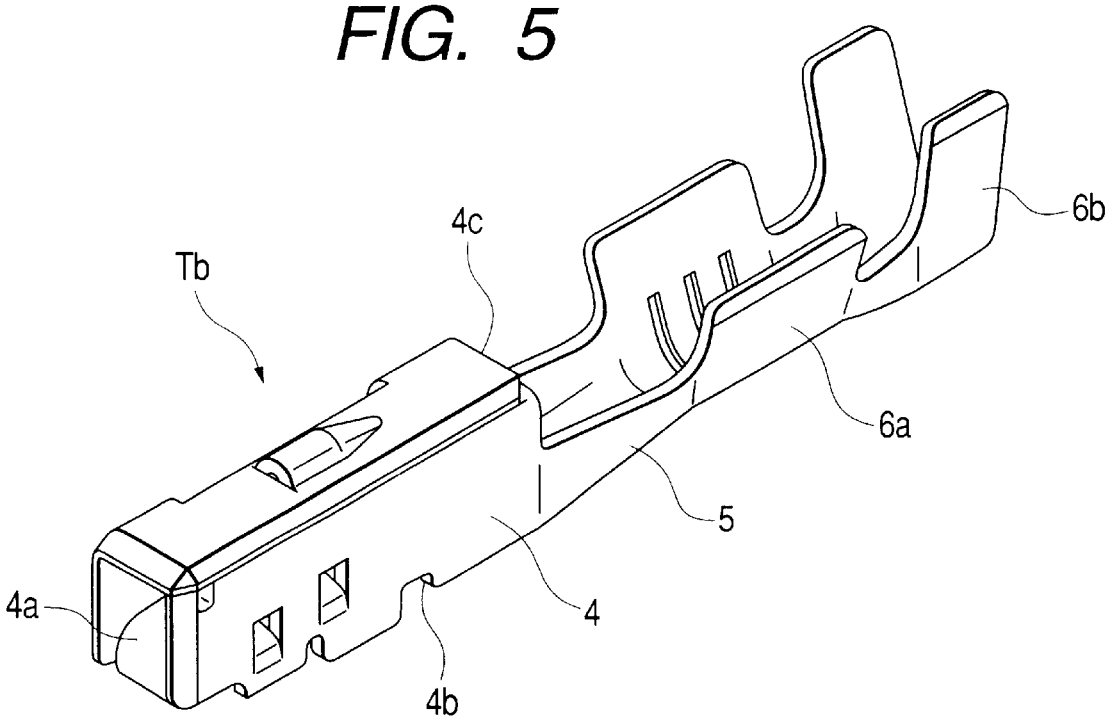
FIG. 5 is a perspective view showing a crimp terminal.
Figure 6:
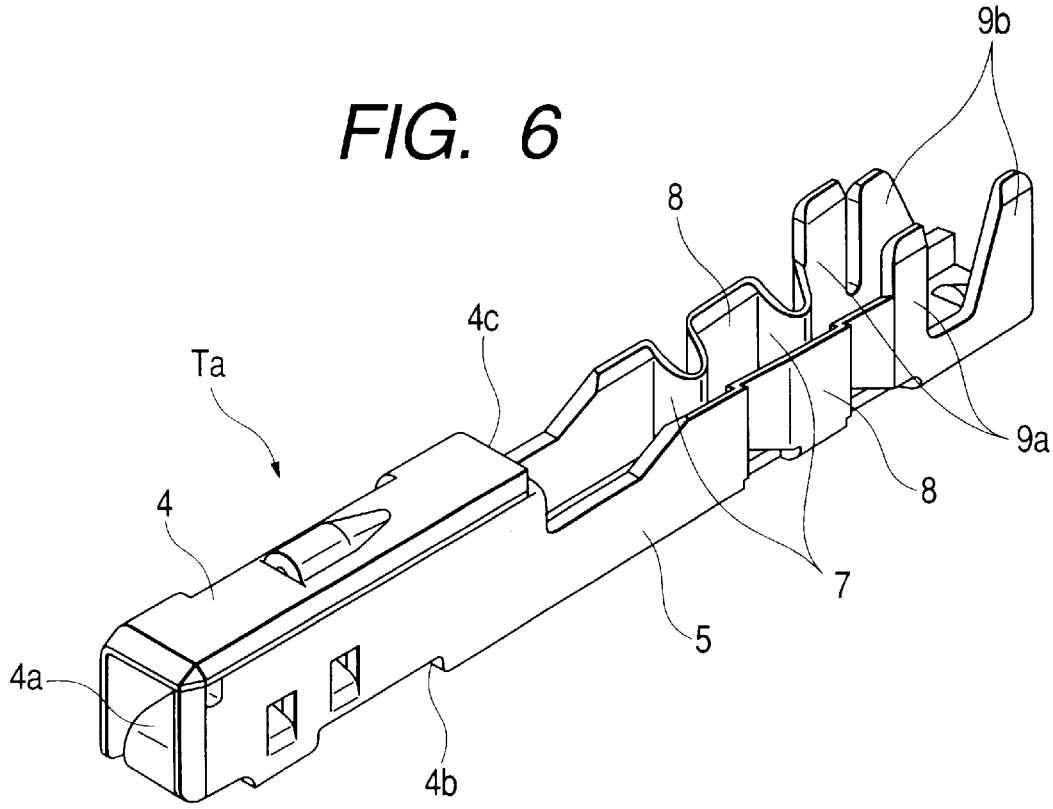
FIG. 6 is a perspective view showing a insulation displacement terminal.
Figure 7:
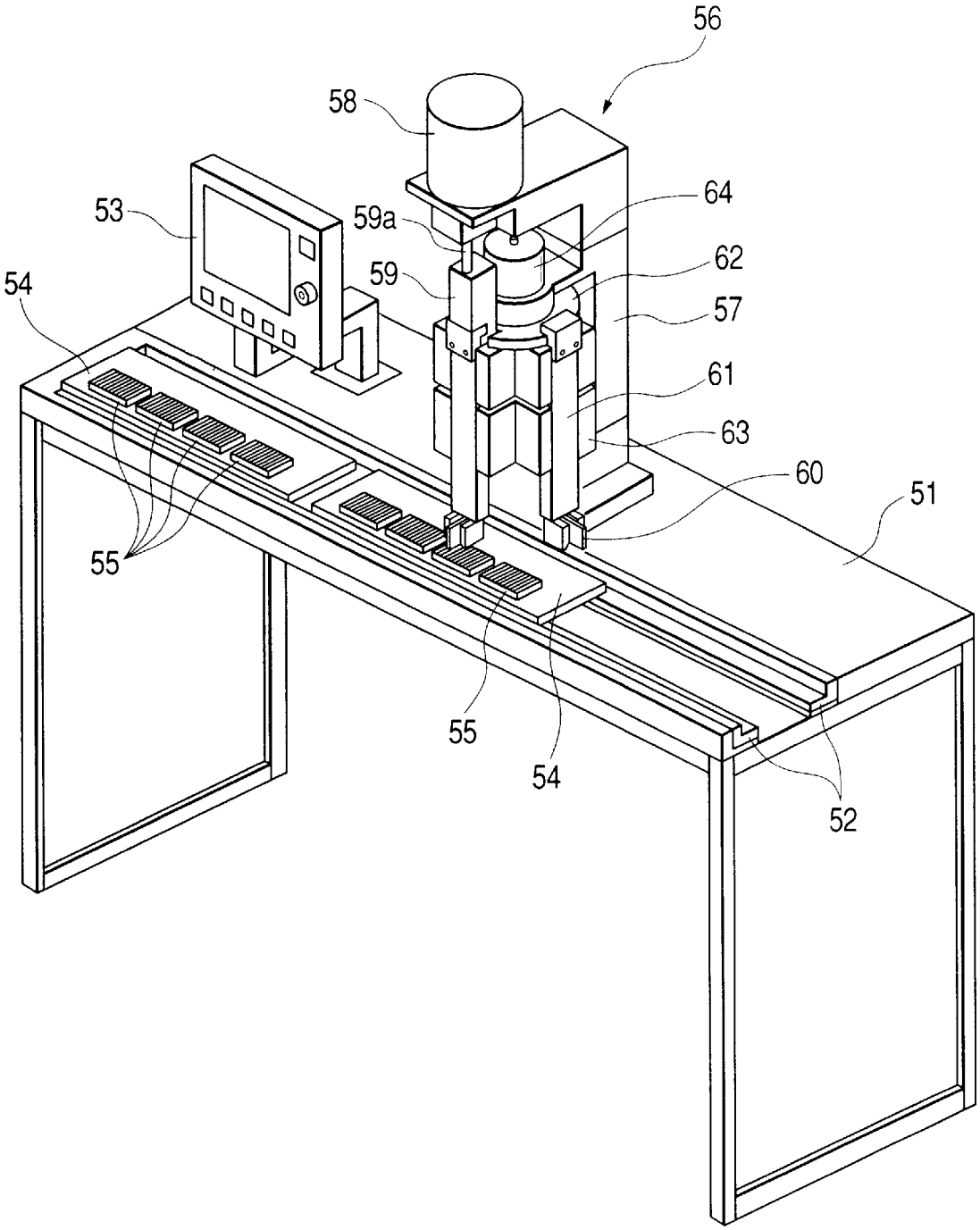
FIG. 7 is a perspective overview of a pressure-connecting apparatus.

A first embodiment embodying the present invention will be described hereinbelow by reference to FIGS. 1A through 8.

A wiring harness 10 according to a first embodiment of the present invention is formed by means of coupling two sub-harnesses 10*a* and 10*b* of pressure-connecting type through use of two after-insertion electric wires WR. Each of the sub-harnesses 10*a* and 10*b* is formed from a plurality of sharable housings Ha through Hg, a plurality of electric wires W, and a plurality of insulation displacement terminals Ta.

The sharable housings Ha through Hg are designed so as to enable insertion of terminal hardware pieces, such as crimp terminals Tb and insulation displacement terminals Ta. The sharable housings Ha through Hg are formed from synthetic resin into a substantially-parallelepiped shape. Cavities 1 are formed in two-layer rows within the sharable housings Ha through Hg, so as to become open in the longitudinal direction. Crimp terminals Tb or insulation displacement terminals Ta are inserted into the cavities 1 from the rear. A lance 1*a* which can deflect in the vertical direction is formed on an upper wall surface at a front section of the inside of the cavity 1 so as to assume a cantilever shape extending in the forward direction. The lance 1*a* is engaged with a lance engagement hole 4*b* of the crimp terminal Tb and with a lance engagement hole 4*b* of the insulation displacement terminal Ta, thereby temporarily holding the crimp terminal Tb and the insulation displacement terminal Ta within the cavities 1. Retainer mount holes 2 communicating with the lower surface of the sharable housings Ha through Hg from the cavities 1 are formed in the sharable housings Ha through Hg. Retainers 3 to be described later are assembled into the retainer mount holes 2.

The retainers 3 are formed from synthetic resin and are inserted into the retainer mount holes 2. As a result, the retainers 3 are assembled into the sharable housings Ha through Hg. The retainers 3 can be engaged at a temporary engagement position (see FIGS. 2 and 3) and an engagement position (see FIG. 4) located deeper than the temporary engagement position within the retainer mount hole 2. Terminal engagement sections 3*a* which can be engaged with both the crimp terminal Tb and the insulation displacement terminal Ta are provided in the retainers 3 in the form of two-layer rows so as to match the cavities 1. When the retainer 3 is located in a temporary engagement position, the terminal engagement section 3*a* is flush with the interior wall surface of the cavity 1. Therefore, insertion and removal of the crimp terminal Tb or the insulation displacement terminal Ta into and from the cavities 1 are allowed. When the retainers 3 are pushed from the temporary engagement position to the engagement position, the terminal engagement section 3*a* proceeds into the cavity 1, to thereby engage with a step of the crimp terminal Tb or a step of the insulation displacement terminal Ta in a normally-inserted state from the rear. The crimp terminal Tb or the insulation displacement terminal Ta that has been inserted is further locked unremovably.

The crimp terminal Tb is to be connected to a core wire Wb which is exposed by means of stripping an insulating sheath Wa at the extremity of the electric wire W. The crimp terminal Tb is formed by means of punching a conductive metal plate into a predetermined shape and bending the thus-punched plate. An angularly cylindrical connection section 4 capable of receiving a tab of male terminal hardware of a mating retainer (not shown) and a resilient contact piece 4*a* which is provided in the connection section 4 and comes into resilient contact with the tab are formed in a front section of the crimp terminal Tb. A lance engagement hole 4*b* capable of engaging with the lance 1*a* in each of the sharable housings Ha through Hg is formed in the connection section 4. A rear edge of the connection section 4 constitutes a step 4*c*, and the terminal engagement section 3*a* of the retainer 3 is engaged with the step 4*c*.

A wire barrel 6*a* and an insulation barrel 6*b* are formed in the rear of the step 4*c* so as to be continuous. The wire barrel 6*a* is shared between the connection section 4 and a bottom wall 5 and is lower than the connection section 4 (shown upside down in FIGS. 2 through 4). The wire barrel 6*a* is crimped to the exposed core wire Wb of the electric wire W, thereby electrically connecting the crimp terminal Tb with the electric wire W. The insulation barrel 6*b* is crimped to the insulation sheath Wa.

Pressure-connecting sections 7 which are to be connected to the internal core wire Wb are formed in the insulation displacement terminal Ta, by means of forming notches in the insulating sheath Wa of the electric wire W. The insulation displacement terminal Ta is formed by means of bending a conductive metal plate punched into a predetermined geometry. The angularly cylindrical connection section 4 capable of receiving a tab of male terminal hardware and the resilient contact piece 4*a* which is provided in the connection section 4 and comes into resilient contact with the tab are formed in a front section of the insulation displacement terminal Ta. The lance engagement hole 4*b* capable of engaging with the lance 1*a* in each of the sharable housings Ha through Hg is formed in the connection section 4. The connection section 4, the resilient contact piece 4*a*, and the lance engagement hole 4*b* of the insulation displacement terminal Ta are formed so as to become identical in shape and size with the connection section 4, the resilient contact piece 4*a*, and the lance engagement hole 4*b* of the crimp terminal Tb. Further, the rear edge of the connection section 4 constitutes the step 4*c*. The terminal engagement section 3*a* of the retainer 3 is engaged with the step 4*c*. More specifically, the step 4*c* of the insulation displacement terminal Ta is formed identical in shape-and size with the step 4*c* of the crimp terminal Tb.

Pressure-connecting sections 7 are formed in the rear of the connection section 4. The pressure-connecting sections 7 are shared between the connection section 4 and the bottom wall 5 and are lower than the connection section 4 (shown upside down in FIGS. 2 through 4). The pressure-connecting sections 7 are formed, by means of bending side walls 8 which stand upright from the bottom wall 5 inwardly so as to assume a V-shaped cross section. The electric wire W is pushed into the space between the sidewalls 8 while the insulating sheath Wa remains unstripped. As a result of the electric wire W being pushed into the space between the sidewalls 8, the V-shaped press section 7 cuts the insulating sheath Wa and comes into contact with the core wire Wb. Thus, the insulation displacement terminal Ta is electrically connected to the electric wire W. The step 4*c* identical with the crimp terminal Tb is formed along the rear edge of the connection section 4*b*. Hence, the pressure-connecting section 7 is lower than the connection section 4. However, the pressure-connecting section 4 is formed into the shape of a letter V. Hence, a broad contact area between the pressure-connecting section 7 and the core wire Wb can be ensured. Consequently, there can be prevented a drop in contact reliability, which would otherwise be caused by reducing the height of the pressure-connecting section 7. In other words, a contact area is ensured by means of forming the pressure-connecting section 7 into the shape of a letter V, thereby forming the step 4*c* while the pressure-connecting sections 7 are made lower.

A pair of tabs 9*a* are projectingly formed at the rear edge of the pressure-connecting sections 7. The tabs 9*a* protrude so as to match in height with the connection section 4. When the insulation displacement contact Ta is inserted into the cavity 1, the upper edge of each of the tabs 9*a* comes into contact with the internal wall of the cavity 1, thereby regulating vertical movement of the rear edge of the insulation displacement terminal Ta. A pair of caulking sections 9*b* are projectingly formed in the rear portions of the tabs 9*a*. When the caulking sections 9*b* are caulked by the insulating sheath Wa of the electric wire W, the electric wire W is fixed.

Figure 8:
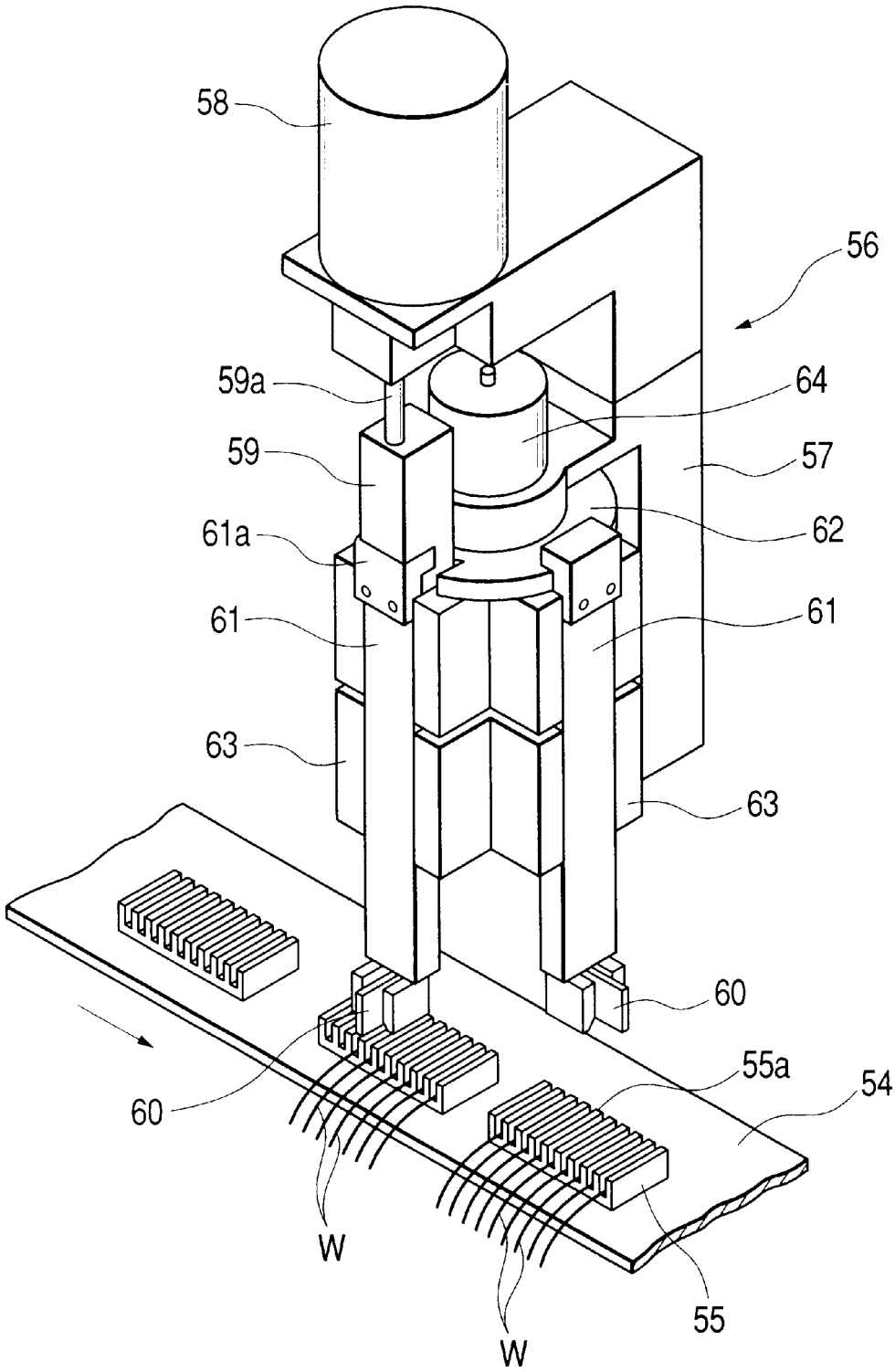
FIG. 8 is an enlarged perspective fragmentary view of the pressure-connecting apparatus.

After the electric wire W has been pressure-connected to the insulation displacement terminal Ta outside the sharable housings Ha through Hg, the insulation displacement terminal Ta is inserted into the sharable housings Ha through Hb. Automatic insertion machines for this purpose will now be described by reference to FIGS. 7 and 8. Rails 52 are laid on a table 51 in the longitudinal direction thereof and in a position closer to the viewer with reference to the lateral direction of the upper surface of the table 51. Pallets 54 which slide over the rails 52 are provided on the rails 52. Pressure-connecting retainers 55 are provided on each of the pallets 54, and pressure-connecting operation is performed on the pallets 54. A pressure-connecting press machine 56 for effecting pressure-connecting operation is provided on the center in the longitudinal direction of the upper surface of the table 51. Further, there are provided a console panel 53 for operating the pressure-connecting press machine 56 and a drive mechanism of each of the pallets 54. As shown in FIG. 8, a servo motor 58 is provided on top of a support member 57, and the servo motor 58 supports a screw shaft 59*a* of a joint lever 59 in a vertically-movable manner by means of a ball screw structure. An upper hook 61*a* of an up-and-down lever 61 of a pressure-connecting jig 60 is fitted to a hook-shaped lower end of the joint lever 59. In association with vertical movement of the joint lever 59 and the screw shaft 59*a*, the up-and-down lever 61 and the pressure-connecting jig 60 are also moved vertically.

Four up-and-low levers 61 of the pressure-connecting jig 60 are provided along the periphery of a disk 62 integrated with the support member 57. Upper-end hooks 61*a* of the up-and-low levers 61 are fitted to the periphery of the disk 62 and are supported by the disk 62 in a slidable manner. The number of pressure-connecting blades is arbitrary. A guide 63 is provided on either side of each of the up-and-low levers 61, and the up-and-low lever 61 vertically travels along a space between guides 63. Each of the guides 63 is rotated by a rotary actuator 64 provided on top of the disk 62. An arbitrary pressure-connecting jig 60 is set to a pressure-connecting position. At this time, the lower-end hook of the joint lever 59 fills in a notch formed in the disk situated at the pressure-connecting position. Hence, movement of the up-and-low lever 61 causes no harm. A pulse motor may be employed in place of the rotary actuator 64.

The pallets 54 are moved in the same manner as are the up-and-low lever 61 of the pressure-connecting press machine 56. More specifically, a screw shaft of a ball screw on which the pallets 54 are fastened is actuated by means of a servo motor. The ball screw and the servo motor are situated below the pallets 54. Hence, although unillustrated, the ball screw and the servo motor are actuated on the same principle on which the up-and-low lever 61 of the pressure-connecting press machine 56 is actuated. Here, details illustrations and explanations thereof are omitted.

When the electric wire W is pressure-connected to the insulation displacement contact Ta, the pallets 54 are placed in a standby condition at predetermined positions. The insulation displacement contact Ta is housed in each of hold grooves 55*a* of each of the pressure-connecting retainers 55, and the electric wire W is supplied to each of the crimp terminals Ta. In this state, the pressure-connecting press machine 56 is actuated, thereby lowering the pressure-connecting jig 60. The pressure-connecting jig 60 presses the electric wire W into the pressure-connecting section 7 of the insulation displacement contact Ta, thereby pressure-connecting the electric wire w to the insulation displacement contact Ta. After pressure-connecting operation, the pressure-connecting jig 60 is elevated and held in a standby condition.

Subsequently, the pallets 54 are moved over the distance equal to a pitch at which the insulation displacement terminals Ta are held in the hold grooves 55*a*. Subsequently, the pressure-connecting jig 60 is lowered, thereby pressure-connecting the electric wire W to the solder-less terminal Ta. After pressure-connecting operation, the pressure-connecting jig 60 is elevated. The foregoing processes are sequentially iterated, so that all the insulation displacement terminals Ta held by the pressure-connecting retainers 55 are pressure-connected to the electric wire W.

After having undergoing pressure-connecting operation, the pressure-connecting retainer 55 is removed from the pallet 54 and transferred to an insertion apparatus (not shown) for inserting the insulation displacement terminals Ta into the sharable housings Ha to Hg. In the insertion apparatus, the pressure-connecting retainers 55 are positioned relative to the sharable housings Ha to Hg so as to fit into corresponding cavities 1 from the rear. In this state, an insertion jig (not shown) presses the tabs 9*a* of the insulation displacement terminals Ta, so that the insulation displacement terminals Ta are inserted into the sharable housings Ha to Hg.

With regard to insertion of the insulation displacement terminals Ta, the insulation displacement terminals Ta may be sequentially inserted into the shareable housings Ha to Hg one by one. Alternatively, all the insulation displacement terminals Ta may be inserted into the shareable cavities 1 simultaneously. In order to prevent removal of the electric wires W from the insulation displacement terminals Ta after pressure-connecting operation, attention is preferably paid to avoid imparting tensile force to the electric wires W. Further, processing preferably proceeds immediately to a process of inserting the insulation displacement terminals into the sharable housings Ha to Hg.

In the present embodiment, the electric wires W are pressure-connected to the insulation displacement terminal Ta of the pressure-connecting retainer 55 one by one. Alternatively, a plurality of pressure-connecting jigs 60 may be provided at the same pitch as that at which the insulation displacement terminals Ta are provided in the hold grooves 55*a*, and a plurality of electric wires W may be pressure-connected to the insulation displacement terminals Ta simultaneously.

Next will be described processes of assembling sub-harnesses 10*a* and 10*b* and manufacturing the wiring harness 10 by means of linking the sub-harnesses 10*a* and 10*b*. As shown in FIG. 1A, the first sub-harness 10*a* is constituted of a plurality of electric wires WF (identical in configuration with the electric wires W), a plurality of insulation displacement terminals Ta pressure-connected to either end of each of the electric wires WF, and the sharable housings Ha through Hd. The insulation displacement terminals Ta are pressure-connected to the ends of the electric wires WF, and the insulation displacement terminals Ta are inserted into the sharable housings Ha through Hd in the same manner as mentioned above. At the time of insertion of the insulation displacement terminals Ta, the retainers 3 are held in the temporary engagement position. The insulation displacement terminals Ta that have been inserted into the regular position in this state are doubly engaged and locked by means of two engagement actions; namely, a first engagement action realized as a result of the lances 1*a* engaging the lance engagement holes 4*b*, and a second engagement action realized as a result of the terminal engagement section 3*a* of the retainer 3 moving to the engagement position after the first engagement action and being engaged with the steps 4*c*. The cavity 1 is formed in each of two sharable housings Hc and Hd so as to enable insertion of the crimp terminal Tb of the after-insertion wire WR.

The second sub-harness 10*b* is assembled in the same manner as the first sub-harness 10*a*. Some second sub-harnesses 10*b* may differ from the first sub-harness 10*a* in terms of the number of the sharable housings He through Hg and the number of electric wires WF and the insulation displacement terminals Ta. Even in the case of the second sub-harness lob, the cavity 1 is formed in each of two sharable housings He and Hg so as to enable insertion of the crimp terminal Tb of the after-insertion wire WR.

The two sub-harnesses 10*a* and 10*b* are connected together by means of the two after-insertion electric wires WR. The crimp terminal Tb is crimped to each end of each of the after-insertion wires WR. The crimp terminal Tb crimped to one end of such an after-insertion wire WR is inserted into a vacant one of the cavities 1 formed in the sharable housings Hc and Hd of the first sub-harness 10*a*. The crimp terminal Tb crimped to the other end of the wire WR is inserted into one of the cavities 1 formed in the sharable housings He and Hg. At the time of insertion of the crimp terminal Tb into the cavity, the retainer 3 is situated at the temporary engagement position, as in the case of insertion of the insulation displacement terminal Ta into the housing. The crimp terminals Tb that have been inserted into the normal position in this state are doubly engaged and locked by means of two engagement actions; namely, a first engagement action realized as a result of the lances 1*a* engaging the lance engagement holes 4*b*, and a second engagement action realized as a result of the terminal engagement section 3*a* of the retainer 3 moving to the engagement position after the first engagement action and being engaged with the steps 4*c*. The cavity 1 is formed in each of two sharable housings Hc and Hd so as to enable insertion of the crimp terminal Tb of the after-insertion wire WR. Thus, the two sub-harnesses 10*a* and 10*b* are connected together by means of the after-insertion electric wires WR, thereby completing the wiring harness 10.

In relation to the sharable housings Hc, Hd, He, and Hg having the insulation displacement terminals Ta and the crimp terminals Tb inserted therein, the lance engagement holes 4*b* to be used for first engagement action and the steps 4*c* to be used for second engagement action are formed to the same shape and size. Hence, the terminal hardware pieces Ta and Tb are doubly engaged in the sharable housings Hc, Hd, He, and Hg without fail. Since the connection sections 4 and the resilient contact pieces 4*a* are formed to be equal in size and shape, the terminal hardware pieces Ta and Tb are connected to the tab of the male terminal hardware without involvement of a problem.

As mentioned above, in the present embodiment, there are used the sharable housings Ha through Hg compatible with the crimp terminals Tb and the insulation displacement terminals Ta as the housings for connecting together the first and second sub-harnesses 10*a* and 10*b*. Only the terminal hardware to be connected to the after-insertion electric wires WR which requires high adhesion strength between the electric wires W and the terminal hardware is embodied as the crimp terminals Tb. Further, the crimp terminals Tb are inserted into the sharable housings Ha through Hg. Further, the insulation displacement terminals Ta are used for the majority of terminal hardware pieces, which do not require high adhesion strength. Hence, the present invention is advantageous in terms of cost and manufacturing efficiency.

Second Embodiment

Figure 9A:
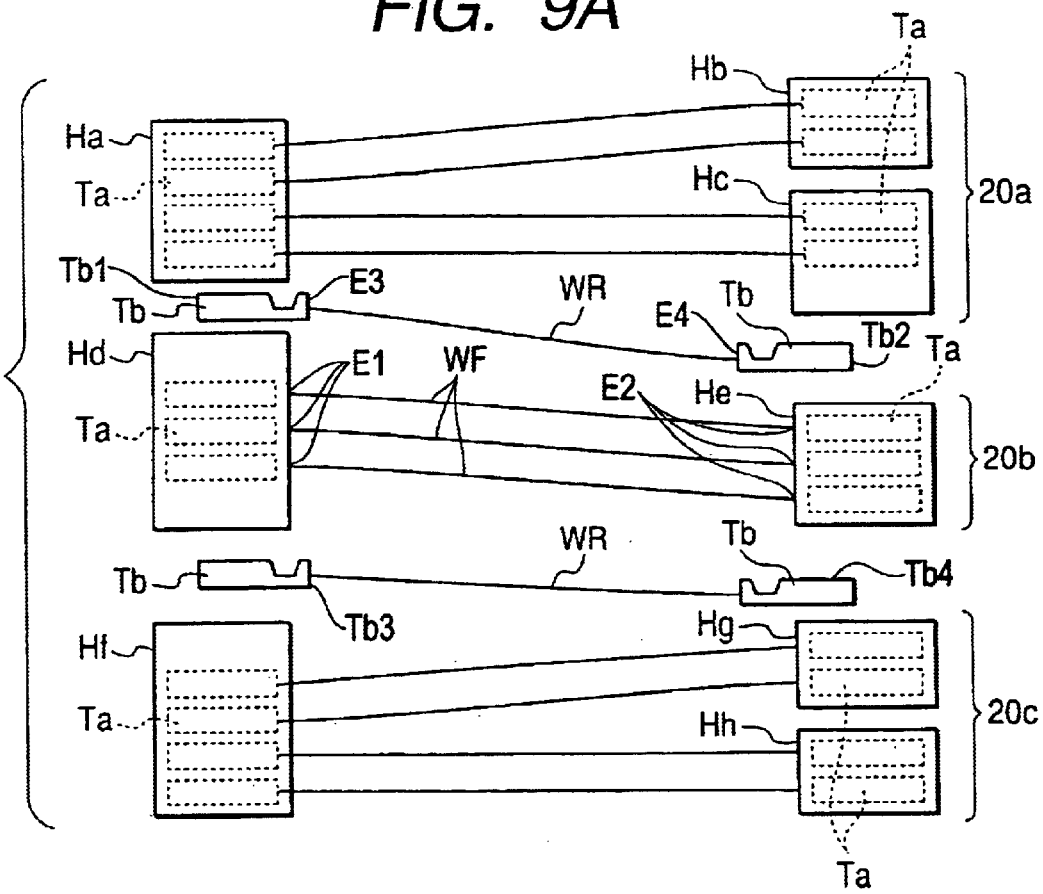
FIGS. 9A and 9B are schematic diagrams showing a sub-harness coupling process according to a second embodiment of the present invention.
Figure 9B:
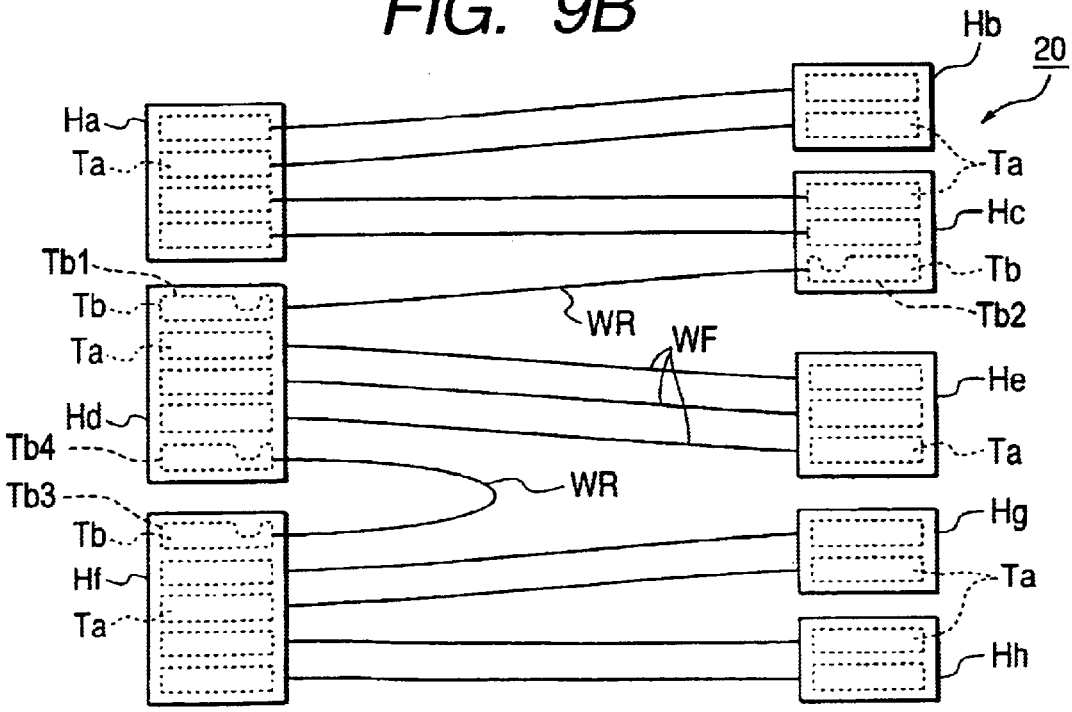

A second embodiment embodying the present invention will be described hereinbelow by reference to FIG. 9.

The second embodiment relates to a wire harness 20 constituted of three sub-harnesses 20*a*, 20*b*, and 20*c* of pressure-connecting type and two after-insertion electric wires WR. In other respects, the present embodiment is identical in construction with the first embodiment. Those constituent elements which are the same as those described in connection with the first embodiment are assigned the same reference numerals. The structure, operation, and working-effect of the wire harness according to the present embodiment are omitted.

The sub-harnesses 20*a*, 20*b*, and 20*c* are assembled in the same manner as do the sub-harnesses 10*a* and 10*b* according to the first embodiment. This includes insulation displacement terminals Ta connected to wires WE at first ends E1 and second ends E2. In connection with the first sub-harness 20*a*, one unoccupied cavity 1 is formed in the sharable housing Ha for enabling insertion of the crimp terminal Tb of the after-insertion electric wire. Further, in connection with the third sub-harness 20*c*, one unoccupied cavity 1 is formed in the sharable housing Hf for enabling insertion of the crimp terminal Tb of the after-insertion electric wire. In the second sub-harness 20*b*, two cavities 1 are formed in the single sharable housing Hd for enabling insertion of the crimp terminal Tb of the inserted after-insertion electric wire WR. In relation to one of the after-insertion electric wires WR, the crimp terminal Tb2 provided at one end E4 of the electric wire WR is inserted into the unoccupied cavity 1 of the sharable housing Hc of the first sub-harness 20*a*. The crimp terminal Tb1 at the other end E3 is inserted into one of two unoccupied cavities 1 of the sharable housing Hd of the second sub-harness 20*a*. Moreover, in connection with the remaining after-insertion electric wire WR, the crimp terminal Tb3 at one end is inserted into an unoccupied cavity 1 of the sharable housing Hf of the third sub-harness 20*c*. Moreover, the crimp terminal Tb4 at the other end is inserted into the remaining one of the two unoccupied cavities 1 of the sharable housing Hd of the second sub-harness 20*b*. Through the foregoing operations, the wire harness 20 is completed.

Third Embodiment

A third embodiment embodying the present invention will be described hereinbelow by reference to FIG. 10.

In the first and second embodiments, a wire harness is constituted by means of interconnecting sub-harnesses. In the third embodiment, however, a wire harness 30 is constituted by means of connecting together a first insulation displacement sub-harness 30*a* and a second crimp sub-harness 30*b*. In other respects, the present embodiment is identical in construction with the first embodiment. Those constituent elements which are the same as those described in connection with the first embodiment are assigned the same reference numerals. The structure, operation, and working-effect of the wire harness according to the present embodiment are omitted.

The first insulation displacement sub-harness 30*a* is assembled in the same manner as do the sub-harnesses 10*a* and 10*b* described in connection with the first embodiment. An unoccupied cavity 1 is formed in each of the sharable housings Ha and Hc of the sub-harness 30*a* for enabling insertion of the crimp terminal Tb of the after-insertion electric wire WR.

Figure 10A:
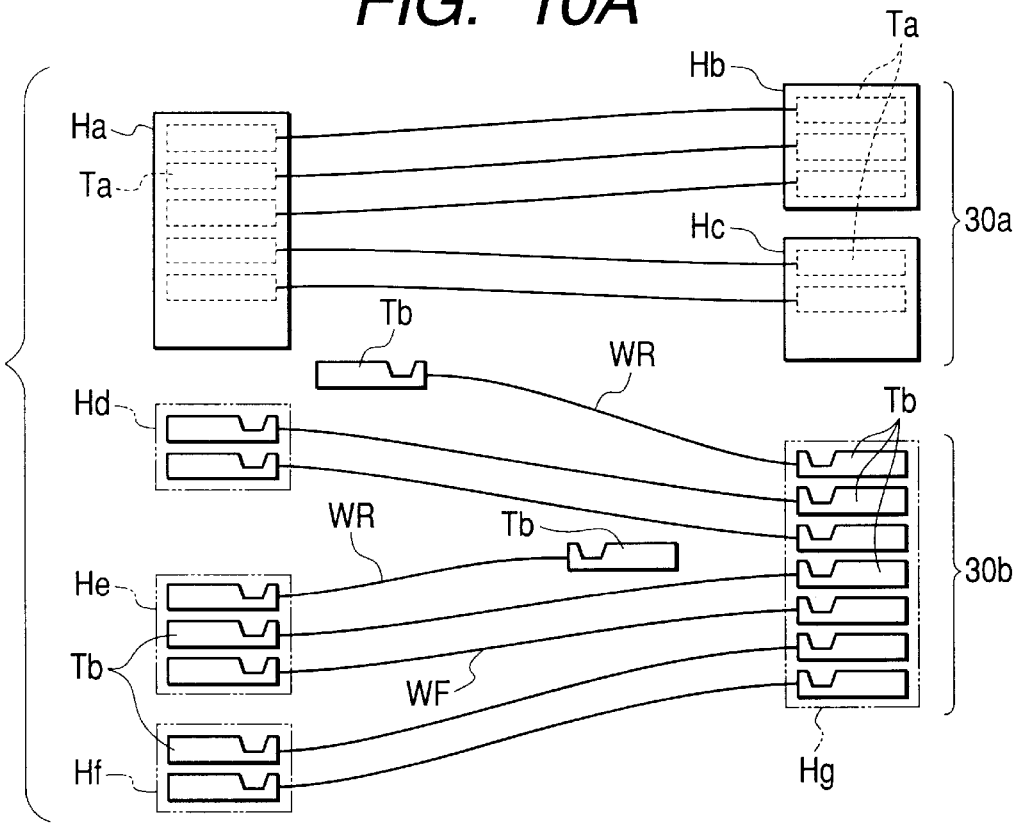
FIGS. 10A and 10B are schematic diagrams showing a sub-harness coupling process according to a third embodiment of the present invention.

The second crimp sub-harness 30*b* employs a plurality of sharable housings Hd to Hg which are identical in construction with those employed in the first sub-harness 30*a*. The crimp terminals Tb crimped to the ends of the electric wires WF are inserted into the respective sharable housings Hd to Hg. As in the case of the first embodiment, the thus-inserted crimp terminal Tb is doubly engaged by the lance 1*a* and the retainer 3. Of the plurality of electric wires W, two electric wires are taken as after-insertion electric wires WR. As shown in FIG. 10A, the crimp terminals Tb crimped to one-side ends of the after-insertion electric wires WR are inserted into the sharable housings He and Hg. The crimp terminal Tb crimped to the-other-side ends of the sharable housings He and Hg remain uninserted and exposed outside. All the crimp terminals Tb crimped to the respective ends of each of the electric wires WF other than the after-insertion electric wires WR are inserted into the sharable housings Hd to Hg.

Figure 10B:
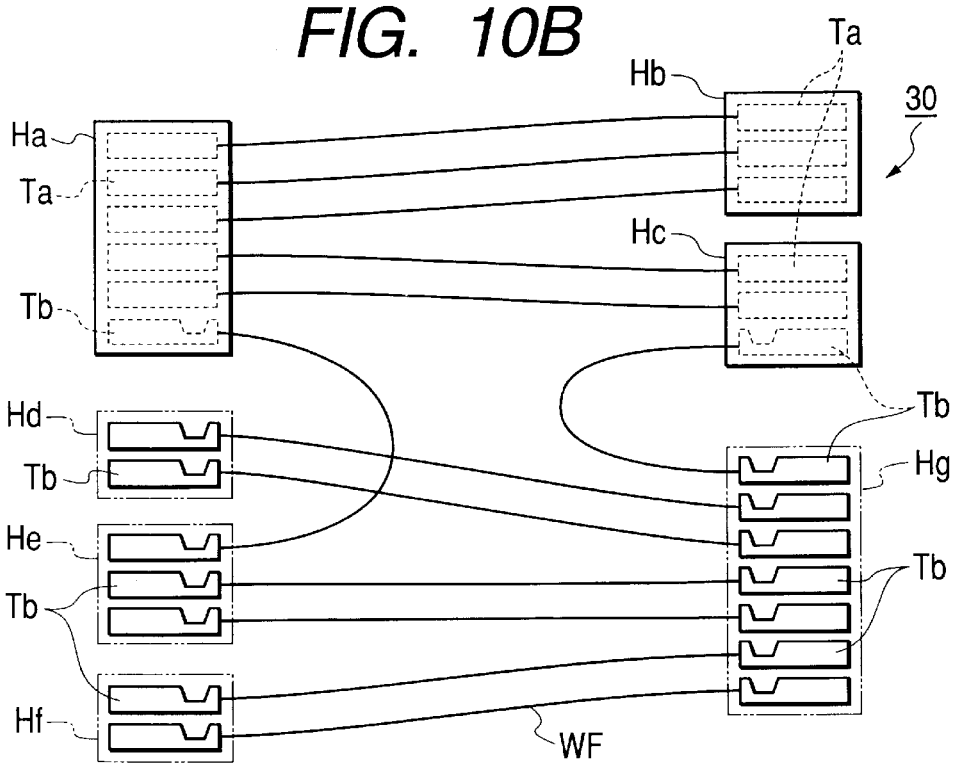

At the time of assembly, the uninserted crimp terminals Tb provided at the-other-side ends of the respective after-insertion electric wires WR are inserted into the unoccupied cavity 1 of the predetermined sharable housings Ha and Hc of the first insulation displacement sub-harness 30*a*. As shown in FIG. 10B, the first insulation displacement sub-harness 30*a* and the second crimp sub-harness 30*b* are connected together by way of the after-insertion electric wire WR, thus completing the wire harness 30.

Fourth Embodiment

Figure 11A:
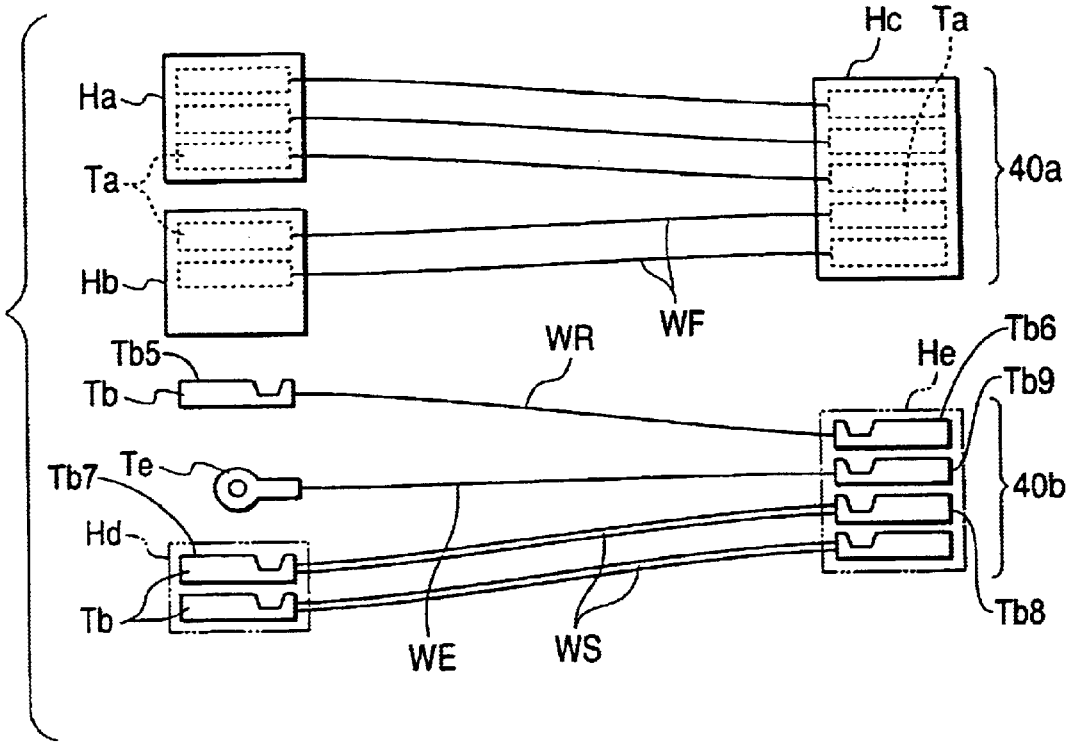
FIGS. 11A and 11B are schematic diagrams showing a sub-harness coupling process according to a fourth embodiment of the present invention.
Figure 11B:
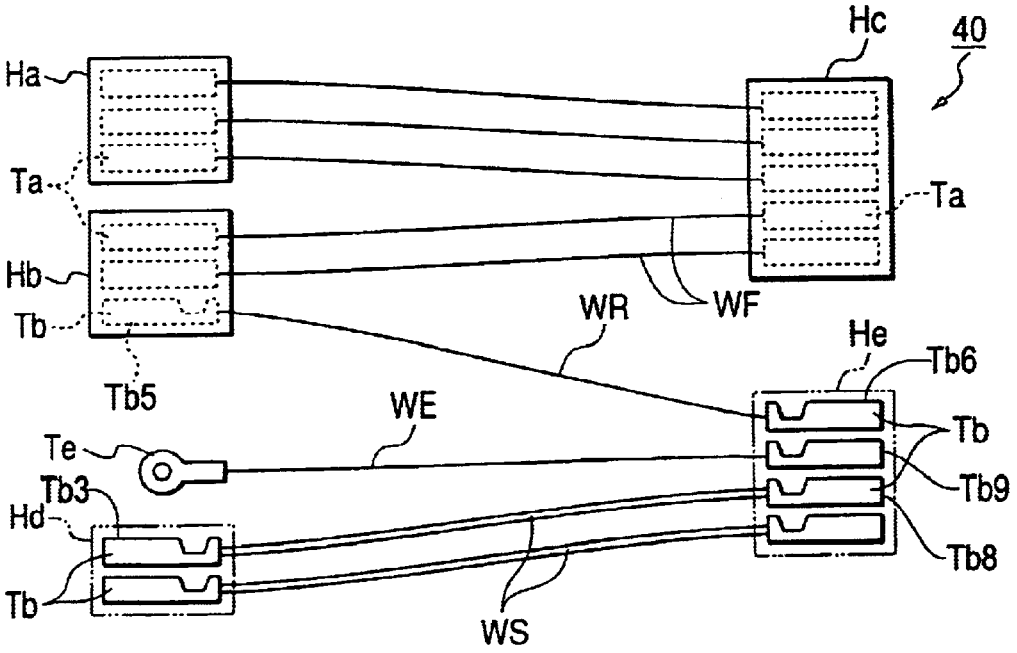

A fourth embodiment embodying the present invention will be described hereinbelow by reference to FIGS. 11A and 11B.

A wire harness 40 according to the fourth embodiment is constituted by means of connecting together a first insulation displacement sub-harness 40*a* and a second crimp sub-harness 40*b*, as in the case of the third embodiment. However, the second sub-harness 40*b* differs in construction from the second sub-harness 30*b* employed in the third embodiment. More specifically, of four electric wires constituting the second sub-harness 40*b*, one electric wire is an after-insertion electric wire WR; one is an earth wire WE; and the remaining two wires are shield wires WS. A crimp terminal Tb5 is crimped to either end of the after-insertion electric wire WR. The crimp terminal Tb6 provided at one end is inserted into the sharable housing He, and the crimp terminal Tb5 provided at the other end remains uninserted and exposed. A crimp terminal Tb9 is provided at one end of the earth electric wire WE by means of crimping. An earth terminal Te is connected to the other end of the earth electric wire WE by means of crimping. A crimped structure formed between the earth terminal Te and the earth electric wire WE is identical with that formed between the after-insertion electric wire WR and the crimp terminal Tb9 Hence explanation of the crimped structure is omitted here. The crimp terminals Tb7 and Tb8 are crimped to either end of the shield wire WS. The crimp terminals Tb7 and Tb8 are inserted into the sharable housings Hd and He, respectively. At the time of assembly, the crimp terminal Tb1 provided at the other end of the after-insertion electric wire WR is inserted into the unoccupied cavity 1 of the sharable housing Hb of the first sub-harness 40*a*. The earth terminal Te is not inserted into any of the housings Ha through He and is fixed to a predetermined earth position (not shown).

Fifth Embodiment

Figure 12A:
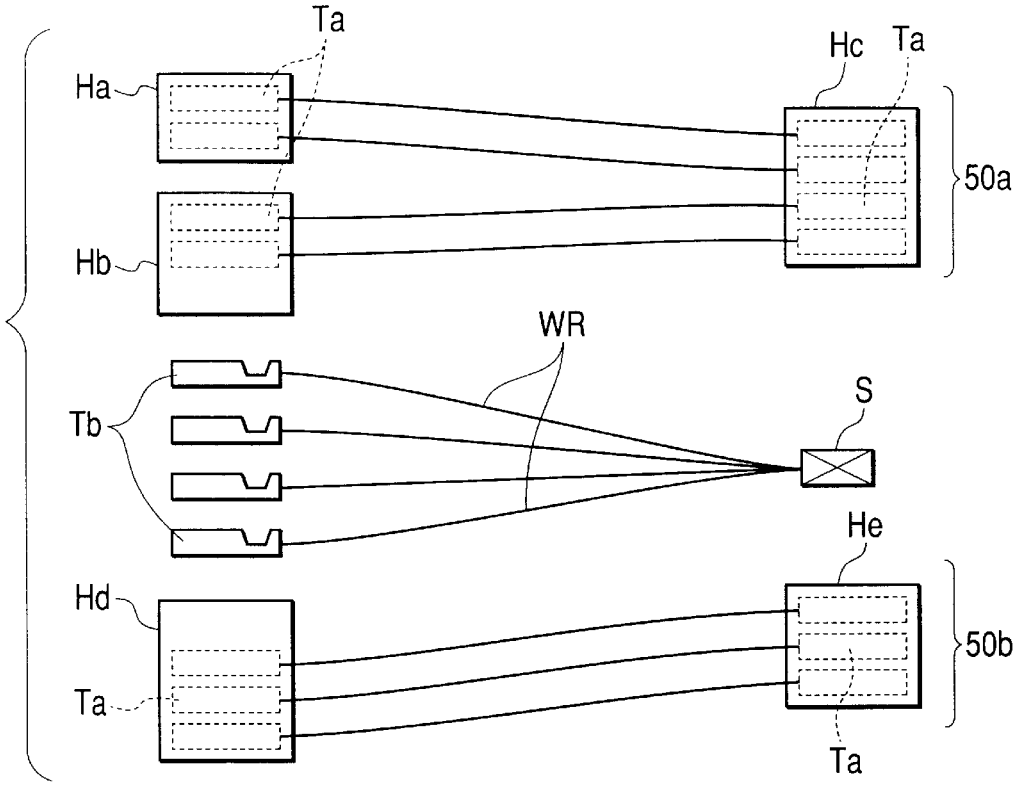
FIGS. 12A and 12B are schematic diagrams showing a sub-harness coupling process according to a fifth embodiment of the present invention.
Figure 12B:
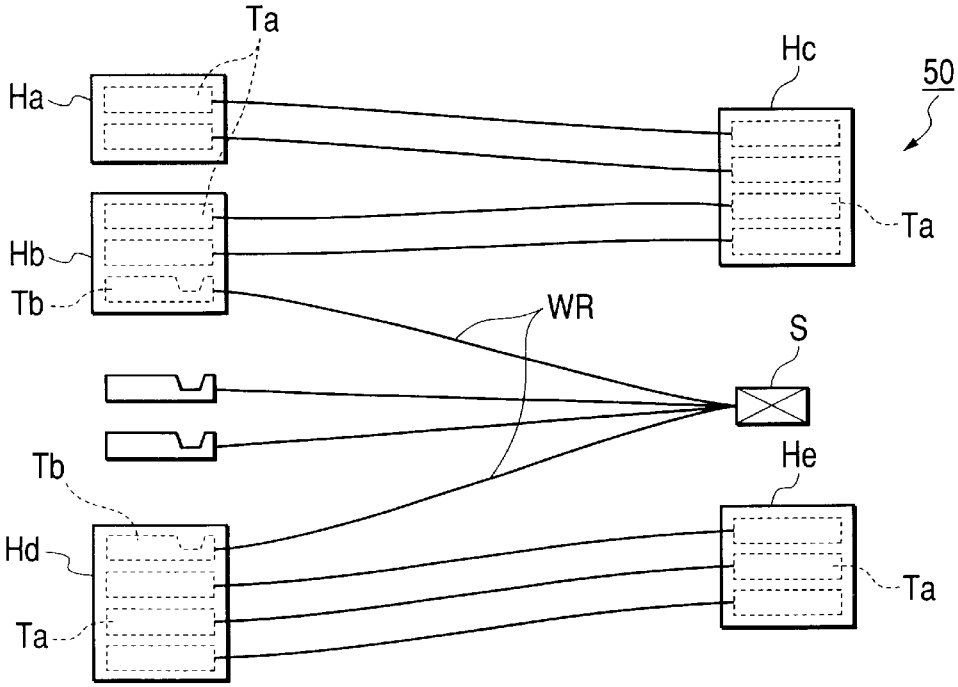

A fifth embodiment embodying the present invention will now be described hereinbelow by reference to FIGS. 12A and 12B. A wire harness 50 according to a fifth embodiment is constituted by means of connecting together a first insulation displacement sub-harness 50*a* and a second insulation displacement sub-harness 50*b* through use of coupling means having a crimp terminal. A plurality of after-insertion electric wires WR serving as coupling means are bundled. One-side ends of the electric wires WR are connected together in a conductive manner by means of a splice ting tool S. The other-side ends of the electric wires WR are individually connected to crimp terminals Tb. Of the plurality of after-insertion electric wires WR, the other end of one after-insertion electric wire WR is inserted into an unoccupied cavity 1 of the sharable housing Hb of the first sub-harness 50*a*. The crimp terminal Tb provided at the other end of another after-insertion electric wire WR is inserted into an unoccupied cavity 1 of the sharable housing Hd of the second sub-harness 50*b*, thereby constituting the wire harness 50.

Sixth Embodiment

Figure 13A:
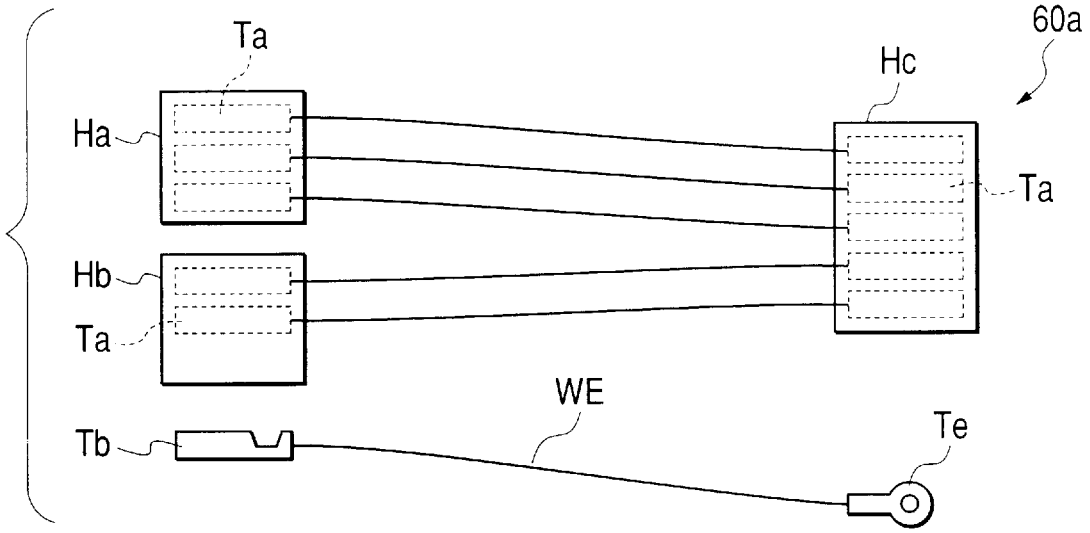
FIGS. 13A and 13B are schematic diagrams showing a modification of the insulation displacement sub-harness according to a sixth embodiment of the present invention.
Figure 13B:
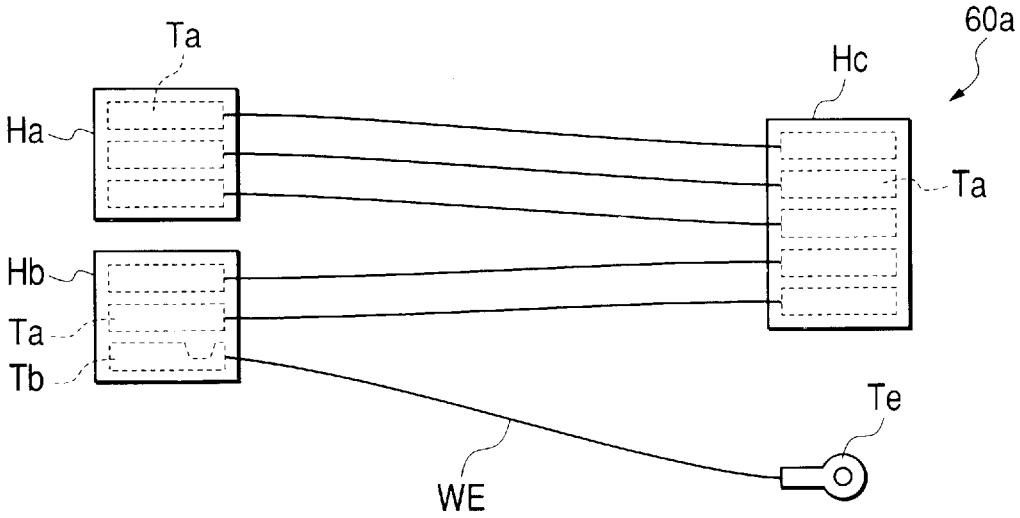
Figure 14:
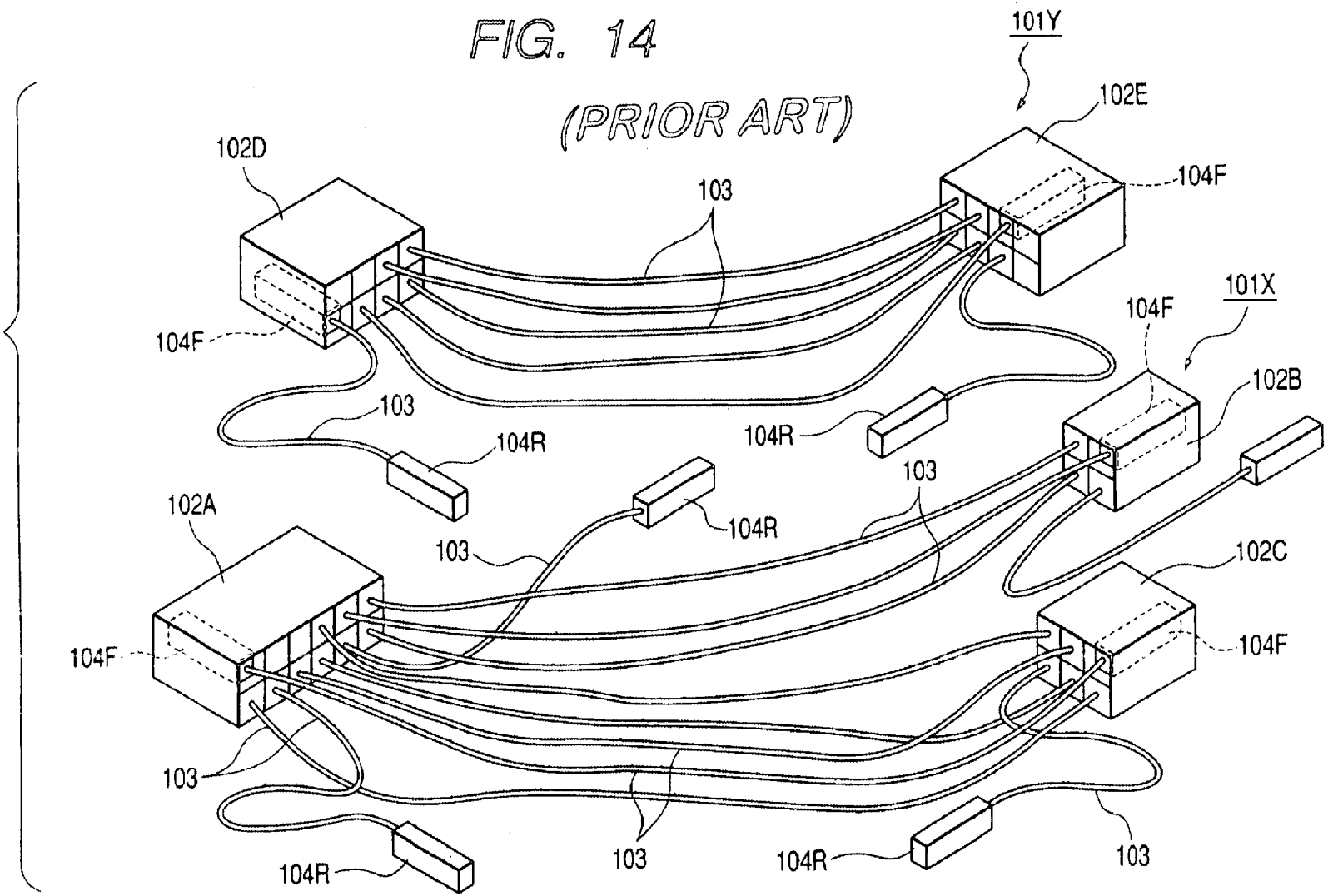
FIG. 14 (PRIOR ART)
FIG. 14 is a perspective view showing related-art sub-harnesses before they are coupled together.

A sixth embodiment embodying the present invention will now be described hereinbelow by reference to FIGS. 13A and 13B.

The sixth embodiment shows a modification of the insulation displacement sub-harness. In the previous embodiments, all insulation displacement terminals Ta are used as terminal hardware constituting the insulation displacement sub-harness. In a sub-harness 60*a* according to the present embodiment, a crimp terminal Tb crimped to one end of the earth wire WE is inserted into one cavity 1 of one sharable housing Hb. Further, the earth terminal Te is connected to the other end of the earth wire WE by means of crimping. The earth terminal Te is not inserted into anyone of the sharable housings Ha to Hc and is connected to grounded at a predetermined earth position (not shown).

Figure 15:
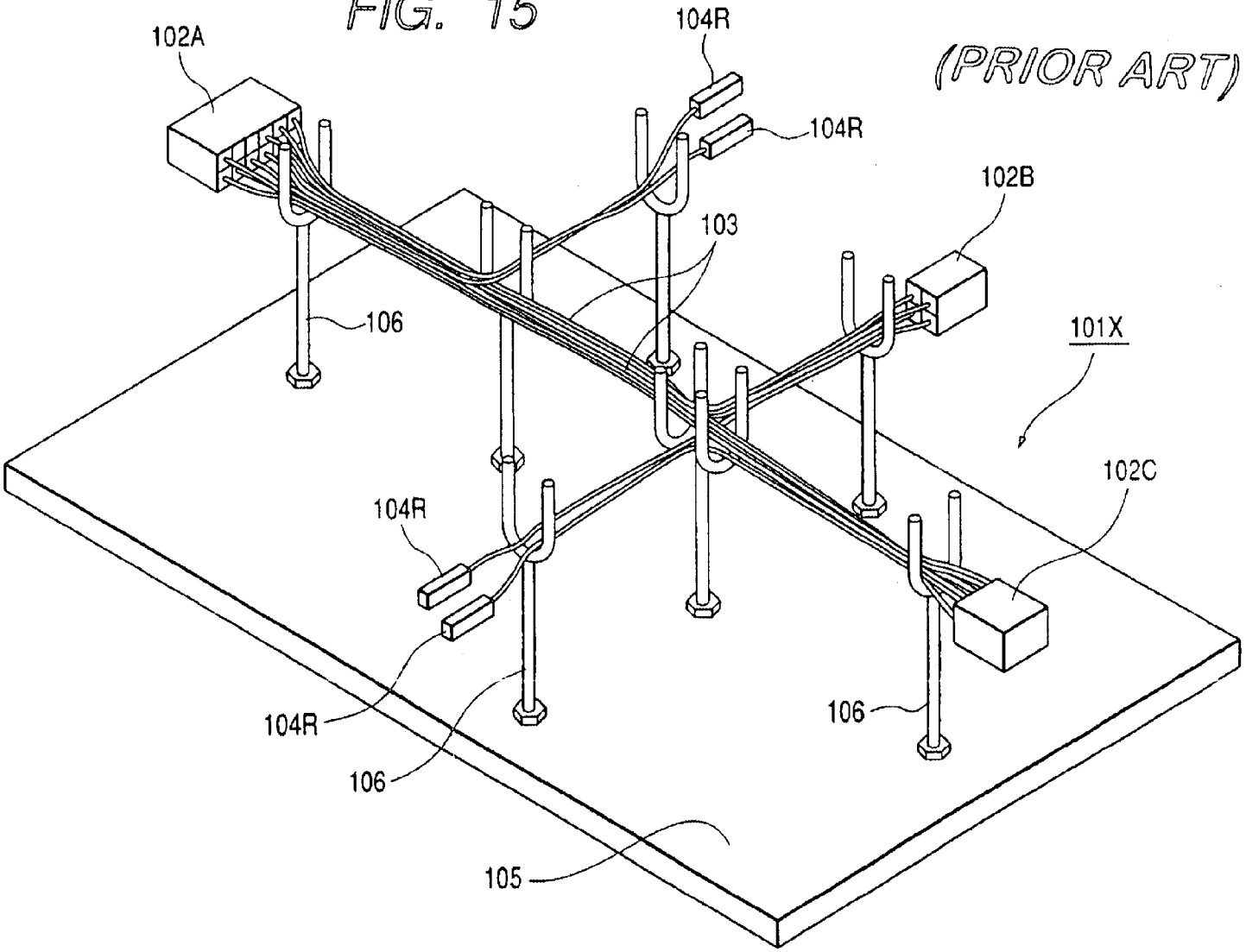
FIG. 15 (PRIOR ART)
FIG. 15 is a perspective view showing a process of coupling related-art sub-harnesses.
Figure 16:
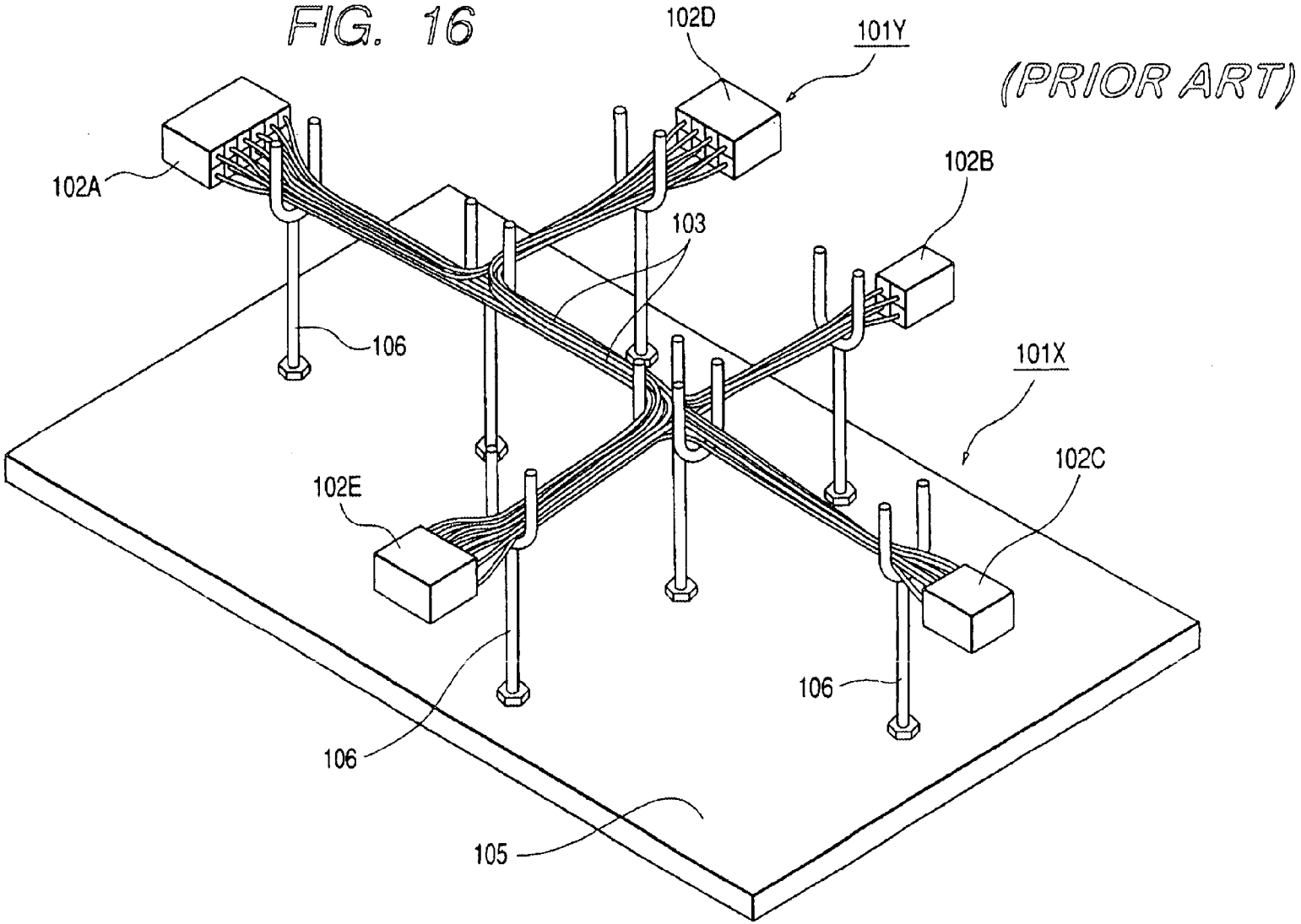
FIG. 16 (PRIOR ART)
FIG. 16 is a perspective view showing a process of coupling related-art sub-harnesses.
Figure 17:
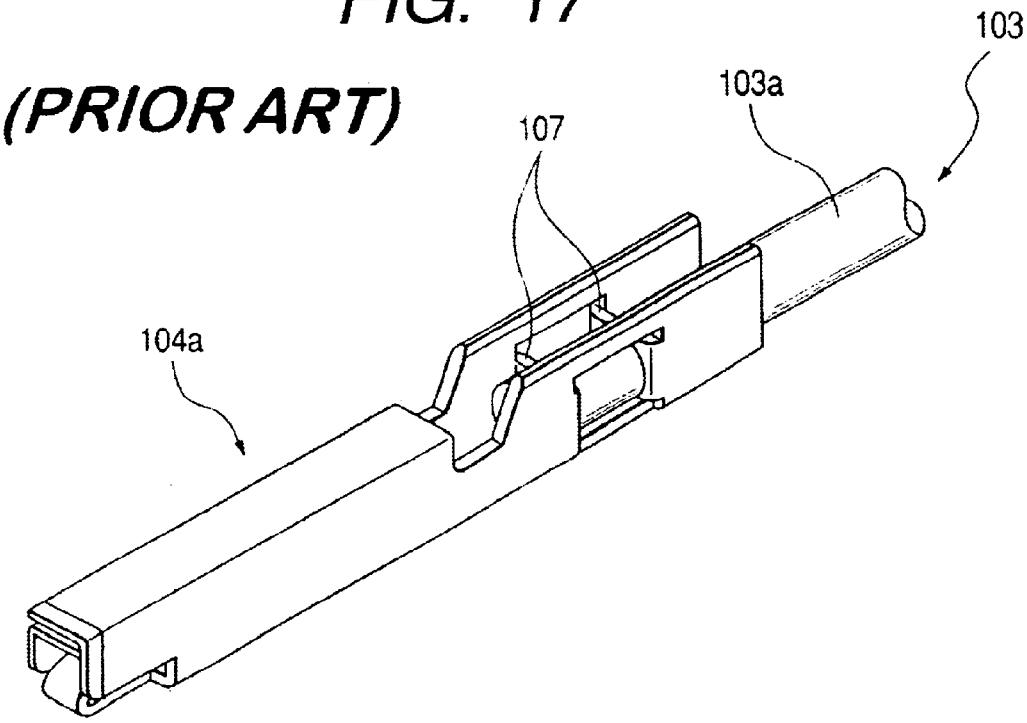
FIG. 17 (PRIOR ART)
FIG. 17 is a perspective view showing a related-art insulation displacement terminal.
Figure 18:
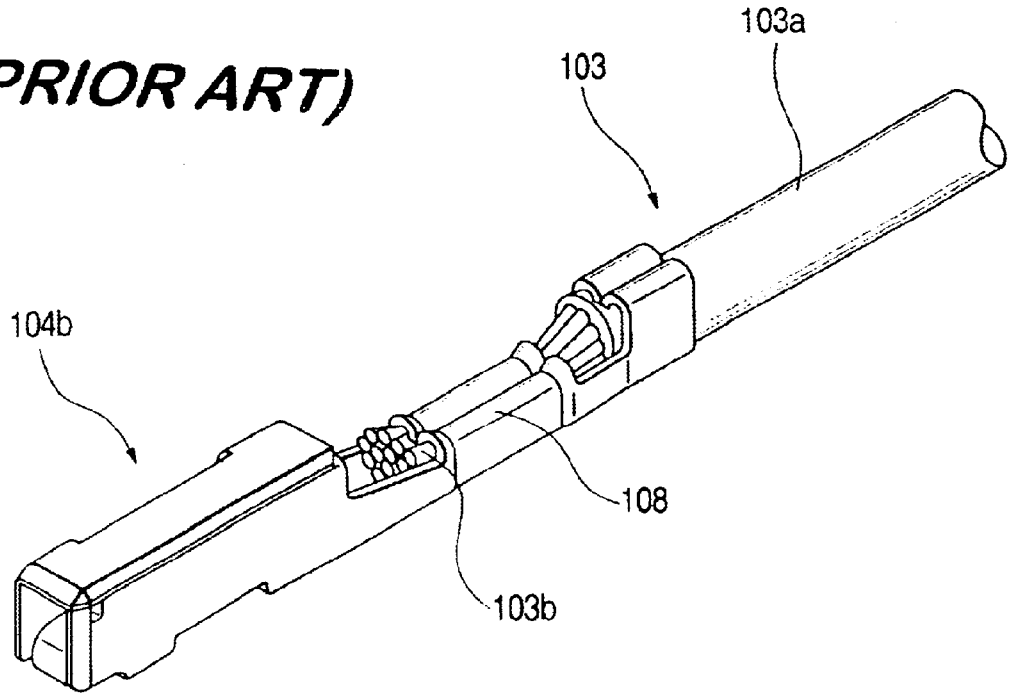
FIG. 18 (PRIOR ART)
FIG. 18 is a perspective view showing a related-art crimp terminal.
Figure 19:
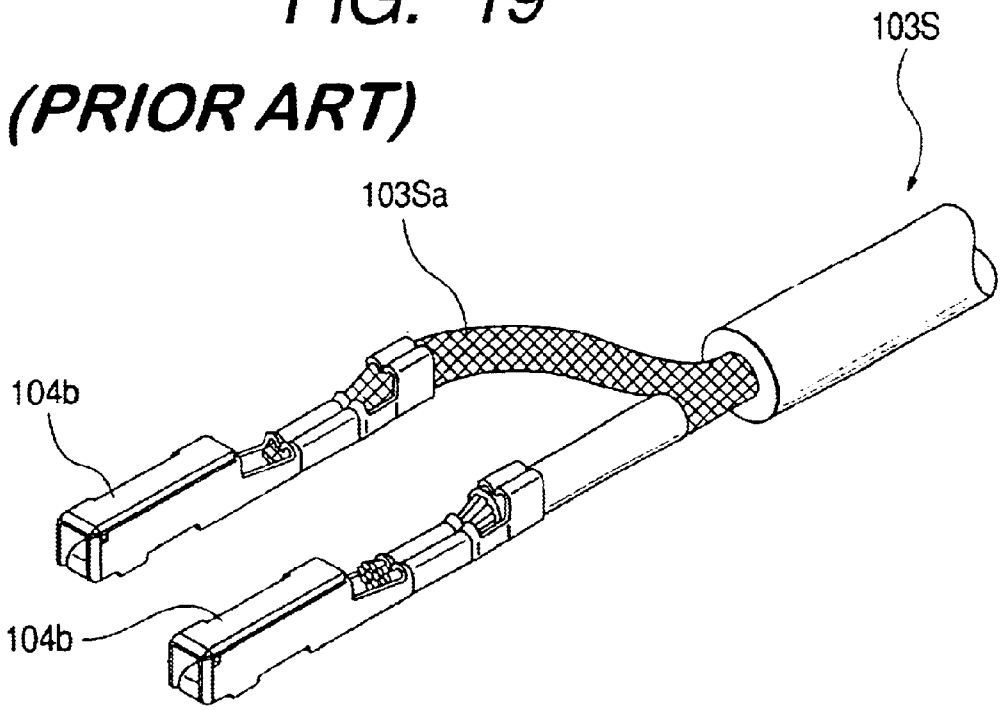
FIG. 19 (PRIOR ART)
FIG. 19 is a perspective view showing a connection between a related-art shield wire and a crimp terminal.
Figure 20:
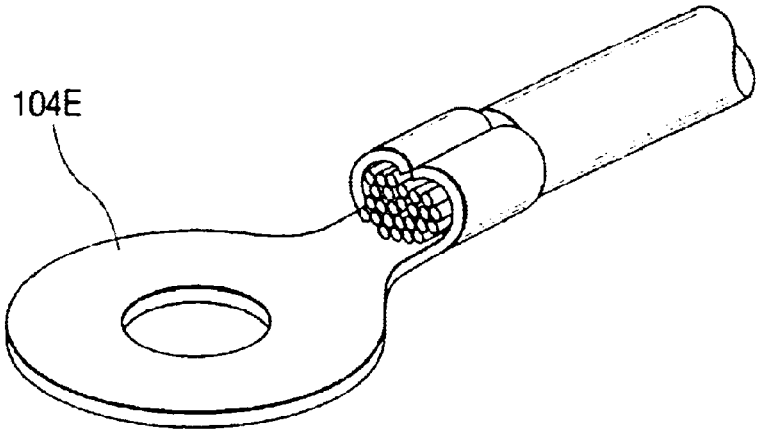
FIG. 20 (PRIOR ART)
FIG. 20 is a perspective view showing related-art connection terminal hardware between an earth terminal and an electric wire.

In each of the embodiments, a wire harness is assembled by means of combining sub-harnesses together on a assembly work bench such as that shown in FIGS. 15 and 16.

Another Embodiment

The present invention is not limited to the embodiments that have been described by reference to the foregoing descriptions and drawings. The following embodiment also falls within the scope invention, and the present invention can be carried out in a modified manner within the scope of the invention.

(1) In the embodiments, all the housings constituting a crimp sub-harness are taken as sharable housings. According to the present invention, housings into which crimp terminals of after-insertion electric wires are to be inserted may be taken as sharable housings. A housing into which crimp terminals of after-insertion electric wires are to be inserted may be taken as a crimp-dedicated housing which enables insertion of only crimp terminals.

(2) In the embodiments, all the housings constituting a crimp sub-harness are taken as sharable housings. However, according to the present invention, one or all housings may be taken as a crimp-dedicated housing which enables insertion of only crimp terminals.

(3) The number of housings constituting one sub-harness is not limited to those described in the embodiments. The number of housings constituting one sub-harness can be set to an arbitrary number.

(4) The number of polarities of one sub-harness is not limited to that described in the embodiment. The number of poles in one housing may be set arbitrarily.

(5) The number of crimp terminals for after insertion purpose to be inserted into one sharable housing of a insulation displacement sub-harness can be set arbitrarily.

(6) The number of after-insertion electric wires to be extended from one housing in the crimp sub-harness can be set arbitrarily.

(7) A crimp sub-harness may include crimp terminals connected to a twist-pair line.

What is claimed is:

1. A wire harness comprising:

a plurality of crimp terminals each crimp terminal clamping a core wire of an electric wire by a wire barrel at an extremity of the electric wire, the extremity thereof stripped to expose the core wire;

a plurality of insulation displacement terminals each insulation displacement terminal having pressure-connecting blades between which the electric wire is inserted, each of the insulation displacement terminals pressure-connecting the electric wire;

first and second sharable housings to which any of the crimp terminals and the insulation displacement terminals is insertable;

a first sub-harness having a plurality of first harness housings including the first shareable housing, the first harness housings having the insulation displacement terminals inserted in the first harness housings;

a second sub-harness having a plurality of second harness housings including the second shareable housing, the second harness housings having the insulation displacement terminals inserted in the second harness housings; and an after-insertion electric wire having first and second crimp terminals provided at corresponding first and second ends, wherein the first crimp terminal, provided at the first end of the after-insertion electric wire, is inserted into the first sharable housing of the first sub-harness;

the second crimp terminal, provided at the second end of the after-insertion electric wire, is inserted into the second sharable housing of the second sub-harness;

the first sharable housing further includes a first retainer mount hole and a first retainer, the first retainer mount hole communicating to a first exterior surface of the first sharable housing from a first inner wall of a first cavity of the first sharable housing, the first retainer preventing removal of said one of either the crimp terminals or the insulation displacement terminals attached to the first retainer mount hole;

the second sharable housing further includes a second retainer mount hole and a second retainer, the second retainer mount hole communicating to a second exterior surface of the second sharable housing from a second inner wall of a second cavity of the second sharable housing, the second retainer preventing removal of said one of either the crimp terminals or the insulation displacement terminals attached to the second retainer mount hole;

one of either the crimp terminals or the insulation displacement terminals is inserted into one of either the first cavity or the second cavity;

the first and second sub-harnesses are connected together by way of the after-insertion electric wire; and the second sub-harness further includes a shield line having third and fourth crimp terminals provided at corresponding first and second shield line ends, and an earth line having at a first earth line end a fifth crimp terminal inserted into the second harness housings, and at a second earth line end an uninserted earth terminal, the third and fourth crimp terminals being inserted into the second harness housings.

2. The wire harness according to claim 1, wherein a connection section is formed in said each of the crimp terminals and of the insulation displacement terminals so as to become identical in shape with a mating terminal;

a step is formed in said each of the crimp terminals so as to become identical in shape with said each of the insulation displacement terminals; and a terminal engagement section is formed in the retainer for preventing removal of said one of either the crimp terminals or of the insulation displacement terminals by engaging with the step.

3. A wire harness formed by combination of a plurality of sub-harnesses, comprising:

a plurality of crimp terminals each clamping a core wire of an electric wire by a wire barrel at an extremity of the electric wire, the extremity thereof stripped to expose the core wire;

a plurality of insulation displacement terminals each having pressure-connecting blades between which the electric wire is inserted, each of the insulation displacement terminals pressure-connecting the electric wire;

a sharable housing to which any of the crimp terminals and the insulation displacement terminals is insertable;

a first sub-harness having a plurality of first harness housings including the shareable housing, the first harness housings having the insulation displacement terminals inserted in the first harness housings;

a second sub-harness having a plurality of second harness housings, the second harness housings having the crimp terminals inserted in the second harness housings; and an after-insertion electric wire having first and second crimp terminals provided at corresponding first and second ends, wherein the first crimp terminal, provided at the first end of the after-insertion electric wire, is inserted into the second harness housings of the second sub-harness;

the second crimp terminal, provided at the second end of the after-insertion electric wire, is inserted into the sharable housing of the first sub-harness;

the sharable housing further includes a retainer mount hole and a retainer, the retainer mount hole communicating to an exterior surface of the sharable housing from an inner wall of a cavity of the sharable housing, and the retainer preventing removal of said one of either the crimp terminals or the insulation displacement terminals attached to the retainer mount hole;

one of either the crimp terminals or the insulation displacement terminals is inserted into the cavity of the sharable housing;

the first sub-harness and the second sub-harness are connected together by way of the after-insertion electric wire;

the second sub-harness further includes a shield line and an earth line;

the shield line includes third and fourth crimp terminals provided at corresponding first and second shield line ends; and the earth line includes at a first earth line end a fifth crimp terminal inserted into the second harness housings, and at a second earth line end an uninserted earth terminal, the third and fourth crimp terminals being inserted into the second harness housings.

4. The wire harness according to claim 3, wherein a connection section is formed in said each of the crimp terminals and of the insulation displacement terminals so as to become identical in shape with a mating terminal;

a step is farmed in said each of the crimp terminals so as to become identical in shape with said each of the insulation displacement terminals; and a terminal engagement section is formed in the retainer for preventing removal of said one of either the crimp terminals or of the insulation displacement terminals by engaging with the step.

5. A wire harness comprising:

a plurality of first electric wires having first ends and second ends;

at least one second electric wire having third and fourth ends;

a first crimp terminal attaching to the third end of the second electric wire;

a second subsequently-inserted crimp terminal being attached to the fourth end of the second electric wire;

third insulation displacement terminals connected to the first electric wires at the first ends and the second ends;

the first crimp terminal, second crimp terminal and third insulation displacement terminals each having a plurality of connection sections, each connecting section having at least one step, the connection sections being identical in shape;

a first sub-harness having at least two harness housings and the plurality of first electric wires, at least one of the at least two harness housings having at least one sharable housing that accommodates the first crimp terminal attached to the third end of the second electric wire, the plurality of first electric wires extending substantially parallel between the at least two harness housings; and a retainer having terminal engagement sections that respectively engage the connection sections to prevent removal either of the first crimp terminal, the second subsequently-inserted crimp terminal or else the third insulation displacement terminals; and a second sub-harness having at least one second sharable housing, the sharable housing accommodating the second subsequently-inserted crimp terminal attached to the fourth end of the second electric wire; wherein the second wire extends to connect the first sub-harness and the second sub-harness.

6. The wire harness according to claim 5, wherein the first and second crimp terminals of the first sharable housing are employed only in a circuit where subsequent insertion operation is required.

7. A wire harness comprising:

a plurality of first electric wires having first ends and second ends;

at least one second electric wire having third and fourth ends;

a first crimp terminal attaching to the third end of the second electric wire;

a second subsequently-inserted crimp terminal being attached to the fourth end of the second electric wire;

third insulation displacement terminals connected to the first electric wires at the first ends and the second ends;

the first crimp terminal, second crimp terminal and third insulation displacement terminals each having a plurality of connection sections, each connecting section having at least one step, the connection sections being identical in shape;

a first sub-harness having at least two harness housings and the plurality of first electric wires, at least one of the at least two harness housings having at least one sharable housing that accommodates the first crimp terminal attached to the third end of the second electric wire; and a retainer having terminal engagement sections that respectively engage the connection sections to prevent removal either of the first crimp terminal, the second subsequently-inserted crimp terminal or else the third insulation displacement terminals; and a second sub-harness having at least one second shamble housing, the sharable housing accommodating the second subsequently-inserted crimp terminal attached to the fourth end of the second electric wire; wherein the second wire extends to connect the first sub-harness and the second sub-harness.

* * * * *